US009689230B2

(12) United States Patent
Andrigo

(10) Patent No.: US 9,689,230 B2
(45) Date of Patent: Jun. 27, 2017

(54) CEMENTING PLUG APPARATUS AND METHOD

(71) Applicant: Top-Co Cementing Products Inc., Weatherford, TX (US)

(72) Inventor: Gregory James Alexander Andrigo, Almonte (CA)

(73) Assignee: Top-Co Cementing Products Inc., Weatherford, TX (US)

( * ) Notice: Subject to any disclaimer, the term of this patent is extended or adjusted under 35 U.S.C. 154(b) by 722 days.

(21) Appl. No.: 13/683,256

(22) Filed: Nov. 21, 2012

(65) Prior Publication Data

US 2014/0138097 A1 May 22, 2014

(51) Int. Cl.
*E21B 33/12* (2006.01)
*E21B 33/16* (2006.01)
*E21B 21/10* (2006.01)

(52) U.S. Cl.
CPC ..... *E21B 33/16* (2013.01); *E21B 21/10* (2013.01); *E21B 33/12* (2013.01)

(58) Field of Classification Search
CPC ..... E21B 33/12; E21B 33/16; E21B 21/10
See application file for complete search history.

(56) References Cited

U.S. PATENT DOCUMENTS 1,938,955 A 7/1927 Crowell
2,305,062 A 5/1940 Church et al.
2,270,648 A 1/1942 Church
3,159,219 A * 12/1964 Scott ..... 166/156
4,589,495 A * 5/1986 Langer ..... E21B 21/10 166/155
5,191,932 A 3/1993 Seefried et al.
6,082,451 A * 7/2000 Giroux ..... E21B 21/10 166/153
6,484,804 B2 * 11/2002 Allamon et al. ..... 166/291
6,497,291 B1 * 12/2002 Szarka ..... E21B 21/10 166/317
7,293,579 B2 * 11/2007 Aardema ..... F16K 15/026 137/513.3
7,428,927 B2 * 9/2008 Vert et al. ..... 166/285
7,640,984 B2 * 1/2010 Vert et al. ..... 166/291
2014/0000909 A1 * 1/2014 Neer ..... E21B 34/108 166/373

* cited by examiner

*Primary Examiner* — Nicole Coy
(74) *Attorney, Agent, or Firm* — Reed & Scardino LLP

(57) ABSTRACT

In an exemplary embodiment, an apparatus includes a valve assembly, the valve assembly including a tubular member and a valve connected thereto, wherein the valve permits fluid flow through the tubular member in a first direction and prevents fluid flow through the tubular member in a second direction that is opposite the first direction. A plug is adapted to be secured to the valve assembly so that the plug is prevented from moving, relative to the valve assembly, in the first and second directions. In an exemplary embodiment, the apparatus is a cementing plug apparatus, which can plug a tubular string or casing so that fluid flow therethrough is prevented. In an exemplary embodiment, the tubular string or casing may be positioned within a preexisting structure such as, for example, a wellbore.

30 Claims, 14 Drawing Sheets

CEMENTING PLUG APPARATUS AND METHOD

BACKGROUND

This disclosure relates in general to oil and gas exploration and production operations, and in particular to plugging a casing that extends within a wellbore, and supporting the casing, to facilitate oil and gas exploration and production operations.

DETAILED DESCRIPTION

Figure 1:
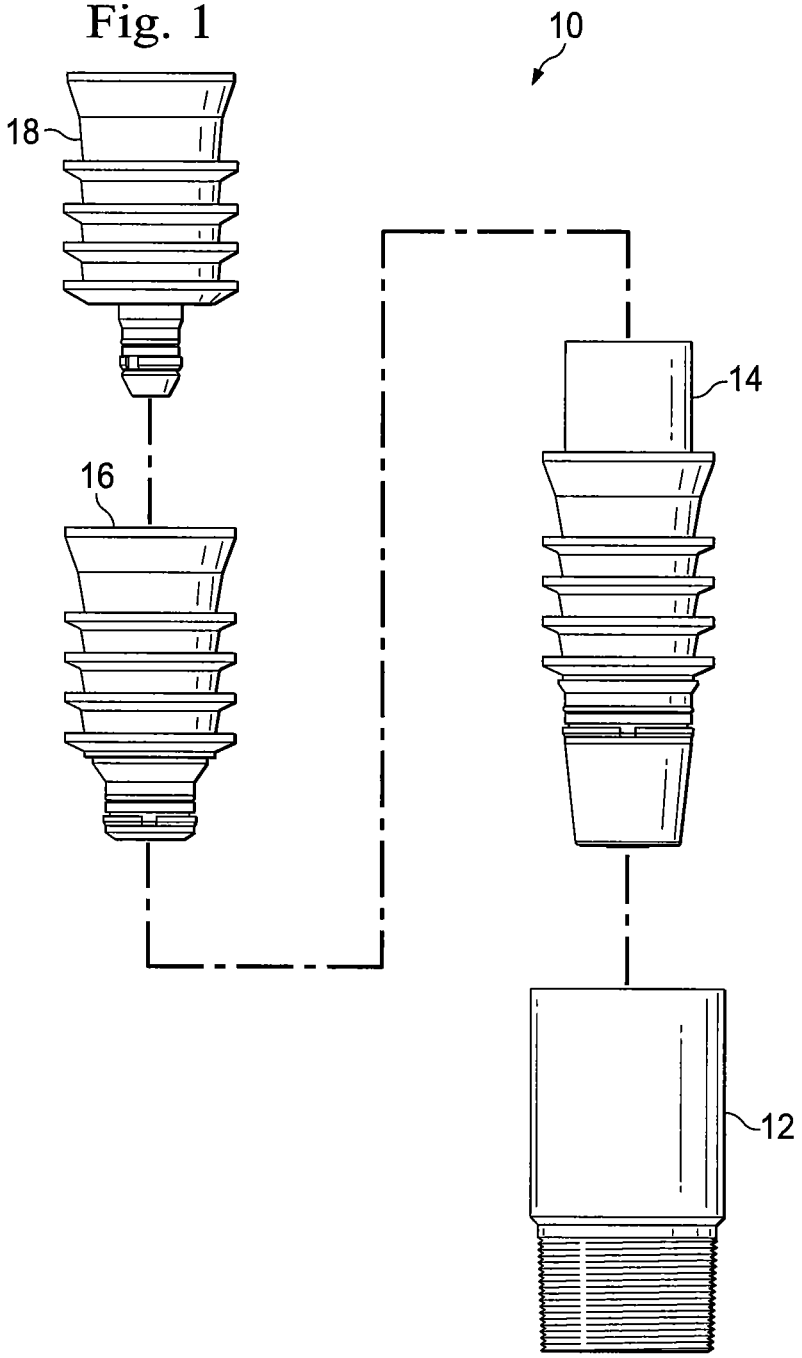
FIG. 1 is an elevation view of an apparatus according to an exemplary embodiment, the apparatus including a landing collar, a valve assembly, a bottom plug, and a top plug.

In an exemplary embodiment, as illustrated in FIG. 1, an apparatus is generally referred to by the reference numeral 10 and includes a landing collar assembly 12, a valve assembly 14, a bottom plug 16, and a top plug 18. Under conditions to be described below, the valve assembly 14 is adapted to be latched or secured to the landing collar assembly 12, the bottom plug 16 is adapted to be latched or secured to the valve assembly 14, and the top plug 18 is adapted to be latched or secured to the bottom plug 16. In several exemplary embodiments, the apparatus 10 is a cementing plug apparatus.

Figure 2:
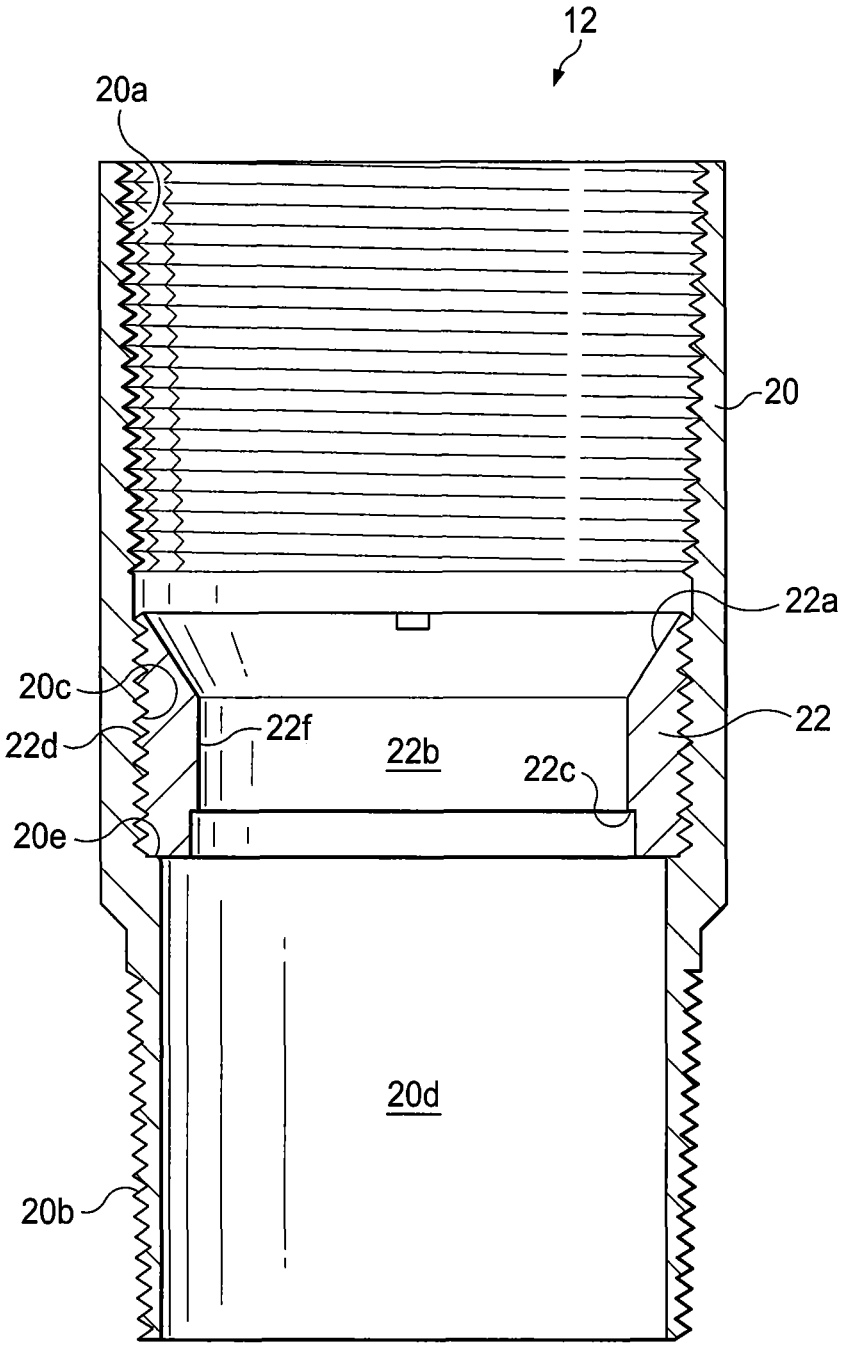
FIG. 2 is sectional view of the landing collar of FIG. 1 according to an exemplary embodiment.

In an exemplary embodiment, as illustrated in FIG. 2 with continuing reference to FIG. 1, the landing collar assembly 12 includes a tubular member, such as a sub 20, and another tubular member, such as a collar 22, connected thereto. The sub 20 includes an internal threaded connection 20*a* at one of its end portions, an external threaded connection 20*b* at the other of its end portions, and an internal threaded connection 20*c* that is axially spaced between the internal threaded connection 20*a* and the external threaded connection 20*b*. The sub 20 defines an internal passage 20*d*. An internal shoulder 20*e* is formed in the inside surface of the sub 20.

The collar 22 defines an internal tapered surface 22*a* at one of its end portions, and an internal passage 22*b*. An internal shoulder 22*c* is formed in the inside surface of the collar 22. The collar 22 further includes an external threaded connection 22*d*, which is threadably engaged with the internal threaded connection 20*a* of the sub 20, thereby connecting the collar 22 to the sub 20. The end of the collar 22 opposing the internal tapered surface 22*a* abuts the internal shoulder 20*e* of the sub 20. An axially-extending surface 22*f* extends between the internal tapered surface 22*a* and the internal shoulder 22*c*.

Figure 3:
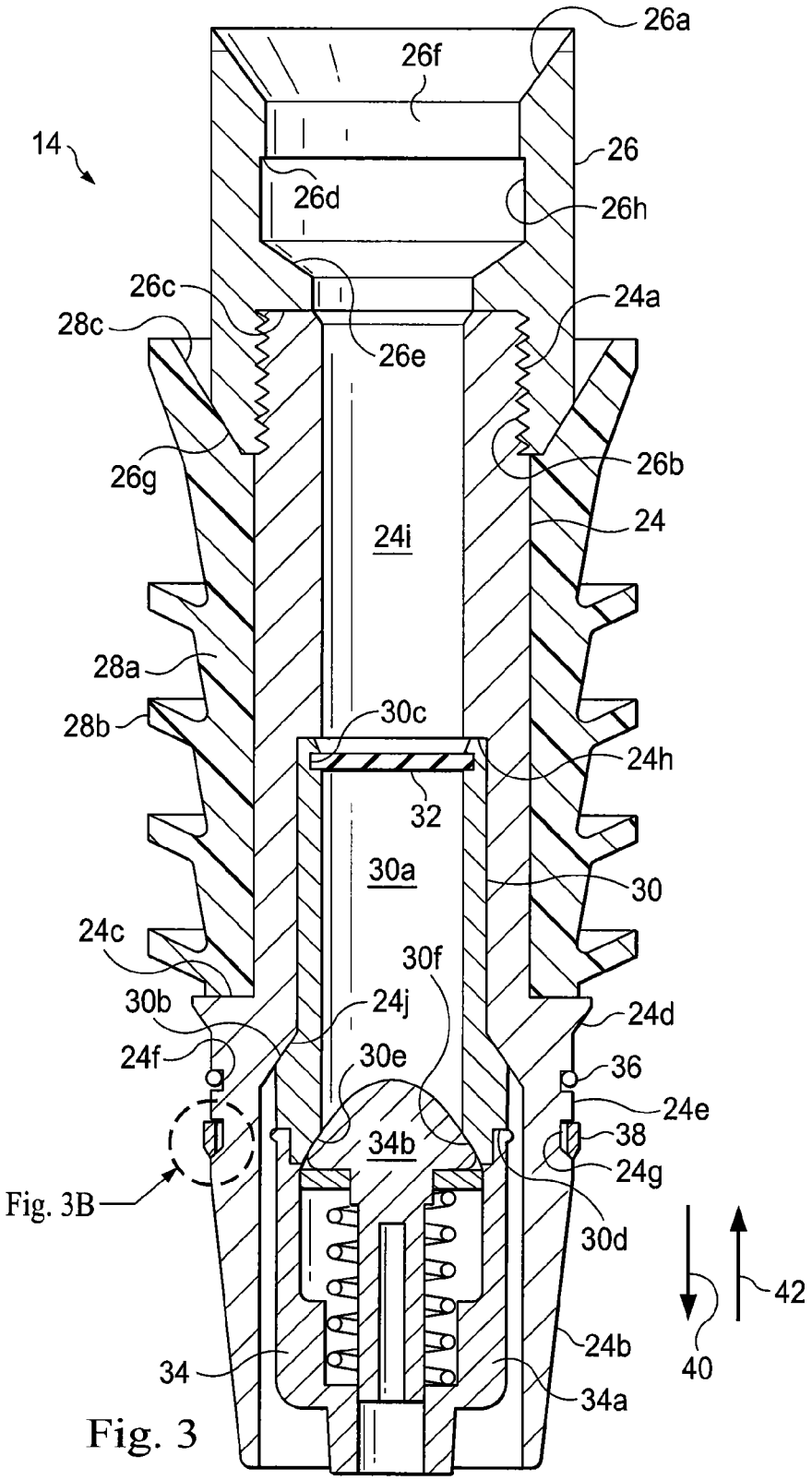
FIG. 3 is a sectional view of the valve assembly of FIG. 1 according to an exemplary embodiment, the valve assembly including a snap ring.

In an exemplary embodiment, as illustrated in FIG. 3 with continuing reference to FIGS. 1 and 2, the valve assembly 14 includes an outside tubular member 24, a tubular member such as an adapter 26, a wiper element 28, an inside tubular member 30, a rupture disc 32, a one-way valve 34, an annular sealing element 36, such an o-ring, and a snap ring 38.

As shown in FIG. 3, the outside tubular member 24 includes an external threaded connection 24*a* at one of its end portions, and an externally tapered end portion 24*b* opposing the external threaded connection 24*a*. An external shoulder 24*c* is formed in the outside surface of the outside tubular member 24, the external shoulder 24*c* being axially positioned between the external threaded connection 24*a* and the externally tapered end portion 24*b*. The outside tubular member 24 defines an external tapered surface 24*d* proximate the external shoulder 24*c*, and an outside cylindrical surface 24*e* extending axially between the external tapered surface 24*d* and the externally tapered end portion 24*b*. An annular groove 24*f* is formed in the outside cylindrical surface 24*e*. The annular sealing element 36 extends within the annular groove 24*f*. An annular channel 24*g* is formed in the outside cylindrical surface 24*e*. The snap ring 38 extends within the annular channel 24*g*. An internal shoulder 24*h* is formed in the inside surface of the outside tubular member 24, and is axially positioned between the external threaded connection 24*a* and the external shoulder 24*c*. The outside tubular member 24 defines an internal passage 24*i*, and an internal frusto-conical surface 24*j* that is axially positioned between the internal shoulder 24*h* and the externally tapered end portion 24*b*.

The adapter 26 defines an internal tapered surface 26*a* at one of its end portions, and includes an internal threaded connection 26*b* at the other of its end portions. The internal threaded connection 26*b* of the adapter 26 is threadably engaged with the external threaded connection 24*a* of the outside tubular member 24, thereby connecting the adapter 26 to the outside tubular member 24. The adapter 26 further includes an internal shoulder 26*c* adjacent the internal threaded connection 26*b* and against which the upper end of the outside tubular member 24 abuts, and an internal shoulder 26*d* axially positioned between the internal tapered surface 26*a* and the internal shoulder 26*c*. An internal tapered surface 26*e* is defined axially between the internal shoulders 26*c* and 26*d*. The adapter 26 further defines an internal passage 26*f*, an external tapered surface 26*g* at the end portion opposing the internal tapered surface 26*a*, and an axially-extending surface 26*h* extending between the internal shoulder 26*d* and the internal tapered surface 26*e*.

The wiper element 28 includes a tubular body 28*a* through which the outside tubular member 24 extends, and a plurality of axially-spaced wipers 28*b* extending radially outward from, and circumferentially around, the tubular body 28*a*. An internal tapered surface 28*c* is defined at one end portion of the wiper element 28. The internal tapered surface 28*c* of the wiper element 28 engages the external tapered surface 26*g* of the adapter 26. The other end portion of the wiper element 28 opposing the internal tapered surface 28*c* engages the external shoulder 24*c* of the outside tubular member 24. As a result, the wiper element 28 is captured, or locked, between the adapter 26 and the external shoulder 24*c* of the outside tubular member 24.

The inside tubular member 30 defines an internal passage 30*a*, and includes a tapered external shoulder 30*b* formed in the outside surface thereof. An internal annular groove 30*c* is formed in the inside surface of the inside tubular member 30 at one end portion thereof. The rupture disc 32 extends within the internal annular groove 30*c*. An axially-facing external shoulder 30*d* is formed in the outside surface of the inside tubular member 30 at the end portion thereof opposing the annular groove 30*c*. An internal circumferentially-extending concave surface 30*e* is defined at the end portion of the inside tubular member 30 opposing the annular groove 30*c*. An opening 30*f* into the internal passage 30*a* is defined by the circumferentially-extending concave surface 30*e*. The inside tubular member 30 extends within the internal passage 24*i* of the outside tubular member 24 so that the upper end of the inside tubular member 30 abuts the internal shoulder 24*h* of the outside tubular member 24, and so that the tapered external shoulder 30*b* abuts the internal frusto-conical surface 24*j* of the outside tubular member 24. The inside tubular member 30 is connected to the outside tubular member 24. In an exemplary embodiment, the inside tubular member 30 is connected to the outside tubular member 24 by adhesive between outside and inside surfaces of the inside tubular member 30 and the outside tubular member 24, respectively, a threaded engagement between an external threaded connection (not shown) of the inside tubular member 30 and an internal threaded connection (not shown) of the outside tubular member 24, an interference fit between the inside tubular member 30 and the outside tubular member 24, mechanical fasteners that extend between the inside tubular member 30 and the outside tubular member 24, or any combination thereof.

The one-way valve 34 includes a tubular member, such as a sleeve 34*a*, the upper end of which abuts the axially-facing external shoulder 30*d* of the inside tubular member 30. The sleeve 34*a* is connected to the inside tubular member 30. In an exemplary embodiment, the sleeve 34*a* is connected to the inside tubular member 30 by adhesive between outside and inside surfaces of the inside tubular member 30 and the sleeve 34*a*, respectively, a threaded engagement between an external threaded connection (not shown) of the inside tubular member 30 and an internal threaded connection (not shown) of the sleeve 34*a*, an interference fit between the inside tubular member 30 and the sleeve 34*a*, mechanical fasteners that extend between the inside tubular member 30 and the sleeve 34*a*, or any combination thereof. A valve element 34*b* is movably coupled to the sleeve 34*a* and is adapted to controllably engage the circumferentially-extending concave surface 30*e* and thus controllably seal the opening 30*f* into the inside tubular member 30. The valve element 34*b* only permits fluidic materials to flow through the internal passage 30*a* of the inside tubular member 30 in a direction indicated by an arrow 40, and prevents fluidic materials from flowing into the internal passage 30*a* via the opening 30*f* in a direction indicated by an arrow 42, which is opposite the direction indicated by the arrow 40. In an exemplary embodiment, the one-way valve 34 is a one-way poppet valve. In several exemplary embodiments, the one-way valve 34 is any type of valve that permits fluid flow in the direction indicated by the arrow 40, but prevents fluid flow in the direction indicated by the arrow 42.

Figure 3A:
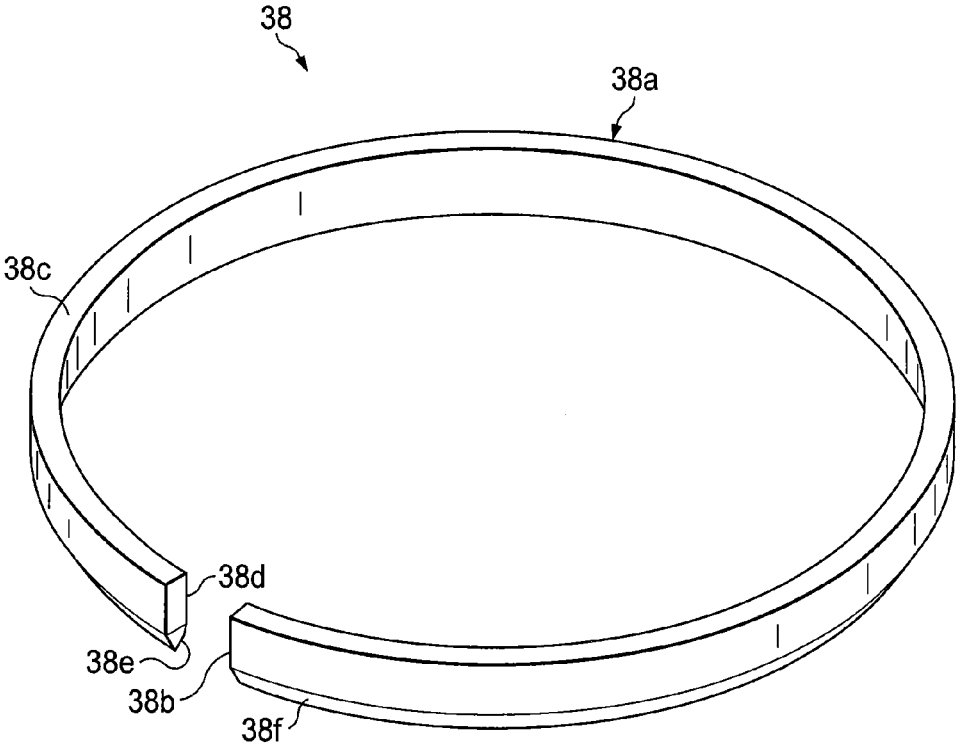
FIG. 3A is a perspective view of the snap ring of FIG. 3 according to an exemplary embodiment.
Figure 3B:
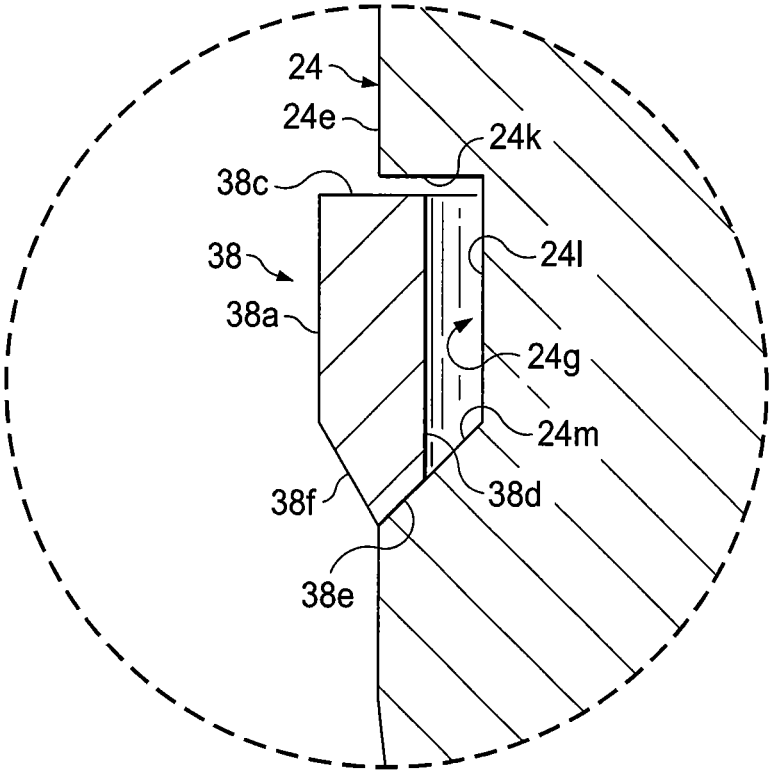
FIG. 3B is an enlarged view of a portion of FIG. 3, according to an exemplary embodiment.

In an exemplary embodiment, as illustrated in FIGS. 3A and 3B with continuing reference to FIGS. 1, 2 and 3, the snap rig 38 includes an annular ring 38*a* having a circumferentially-extending segment removed therefrom to thereby define a break 38*b*. The annular ring 38*a* defines an axially-facing surface 38*c*, an axially-extending surface 38*d* extending downward from the axially-facing surface 38*c*, a frusto-conical surface 38*e* extending downward from the axially-extending surface 38*d*, and an external tapered surface 38*f*, the lower end of which meets the lower end of the frusto-conical surface 38*e*.

As noted above and shown in FIG. 3B, the snap ring 38 extends within the annular channel 24*g* of the outside tubular member 24. The annular channel 24*g* defines an axially-facing surface 24*k*, an axially-extending surface 24*l* extending downward from the axially-facing surface 24*k*, and a frusto-conical surface 24*m* extending downward from the axially-extending surface 24*l*. The snap ring 38 is sized so that it is permitted to shift axially, and radially compress and expand, within the annular channel 24*g*, under conditions to be described below.

Figure 4:
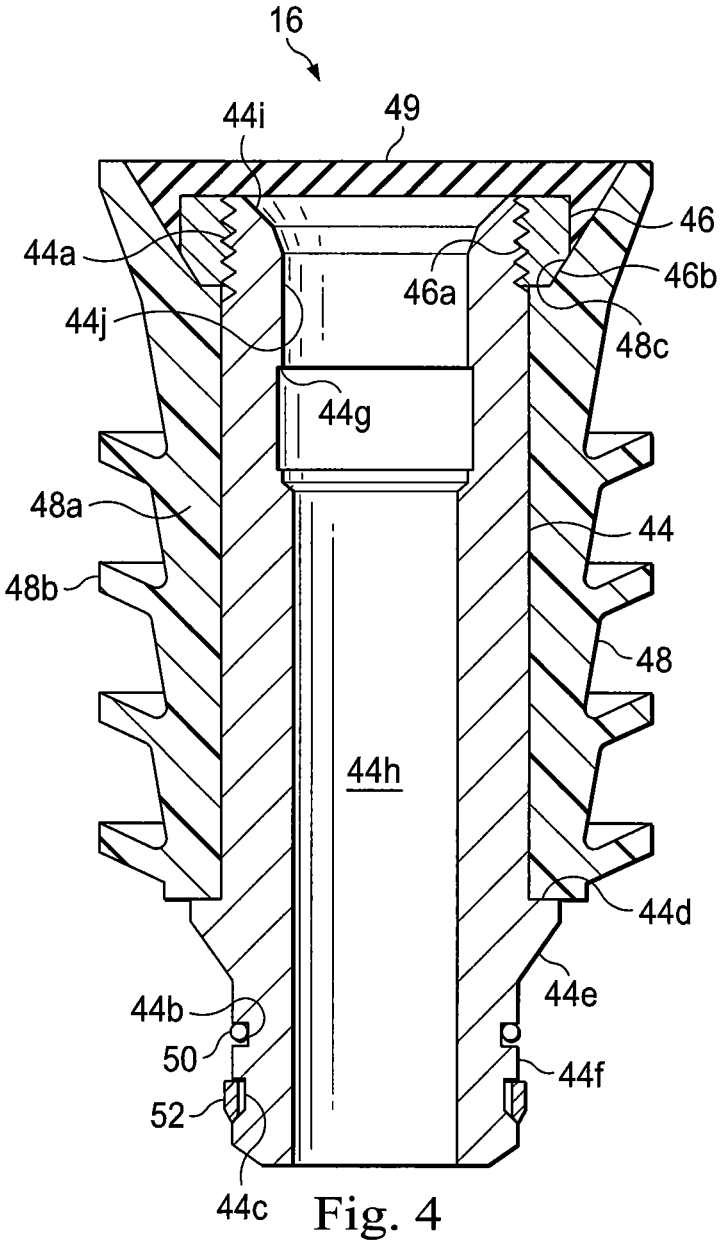
FIG. 4 is a sectional view of the bottom plug of FIG. 1 according to an exemplary embodiment.

In an exemplary embodiment, as illustrated in FIG. 4 with continuing reference to FIGS. 1, 2, 3, 3A and 3B, the bottom plug 16 includes a tubular member 44, an annular locking element 46, a wiper element 48, a rupture disc 49, an annular sealing element 50, and a snap ring 52.

The tubular member 44 includes an external threaded connection 44*a* at one of its end portions, and an annular groove 44*b* and annular channel 44*c* axially spaced from one another at the other of its end portions. An external shoulder 44*d* is formed in the outside surface of the tubular member 44, the external shoulder 44*d* being axially positioned between the external threaded connection 44*a* and the annular groove 44*b*. The tubular member 44 defines an external tapered surface 44*e* proximate the external shoulder 44*d*, and an outside cylindrical surface 44*f* extending axially downward therefrom and in which the annular groove 44*b* and the annular channel 44*c* are formed. Except for any dimensional variations, the annular channel 44*c* is identical to the annular channel 24*g* and therefore the annular channel 44*c* will not be described in detail. An internal shoulder 44*g* is formed in the inside surface of the tubular member 44. The tubular member 44 defines an internal passage 44*h* therethrough, an internal tapered surface 44*i* at the end portion thereof at which the external threaded connection 44*a* is located, and an axially-extending internal surface 44*j* positioned between the internal tapered surface 44*i* and the internal shoulder 44*g*.

The annular locking element 46 includes an internal threaded connection 46*a*, and defines an external tapered surface 46*b* at the bottom end portion of the annular locking element 46. The internal threaded connection 46*a* is threadably engaged with the external threaded connection 44*a*, thereby connecting the annular locking element 46 to the tubular member 44.

The wiper element 48 includes a tubular body 48*a* through which the tubular member 44 extends, and a plurality of axially-spaced wipers 48*b* extending radially outward from, and circumferentially around, the tubular body 48*a*. An internal tapered surface 48*c* is defined at one end portion of the wiper element 48, and engages the external tapered surface 46*b* of the annular locking element 46. The other end portion of the wiper element 48 opposing the internal tapered surface 48*c* engages the external shoulder 44*d* of the tubular member 44. As a result, the wiper element 48 is captured, or locked, between the locking element 46 and the external shoulder 44*d* of the tubular member 44.

The rupture disc 49 extends across the locking element 46 and thus the upper opening to the internal passage 44*h*. In an exemplary embodiment, as shown in FIG. 4, the rupture disc 49 engages the respective upper end portions of the wiper element 48, the locking element 46, and the tubular member 44. In an exemplary embodiment, the rupture disc 49 is connected to one or more of the wiper element 48, the locking element 46, and the tubular member 44 by adhesive(s), threaded engagement(s), mechanical fastener(s), or any combination thereof.

The annular sealing element 50 extends within the annular groove 44*b*. The snap ring 52 extends within the annular channel 44*c*. Except for any dimensional variations, the snap ring 52 is identical to the snap ring 38 and therefore the snap ring 52 will not be described in detail.

Figure 5:
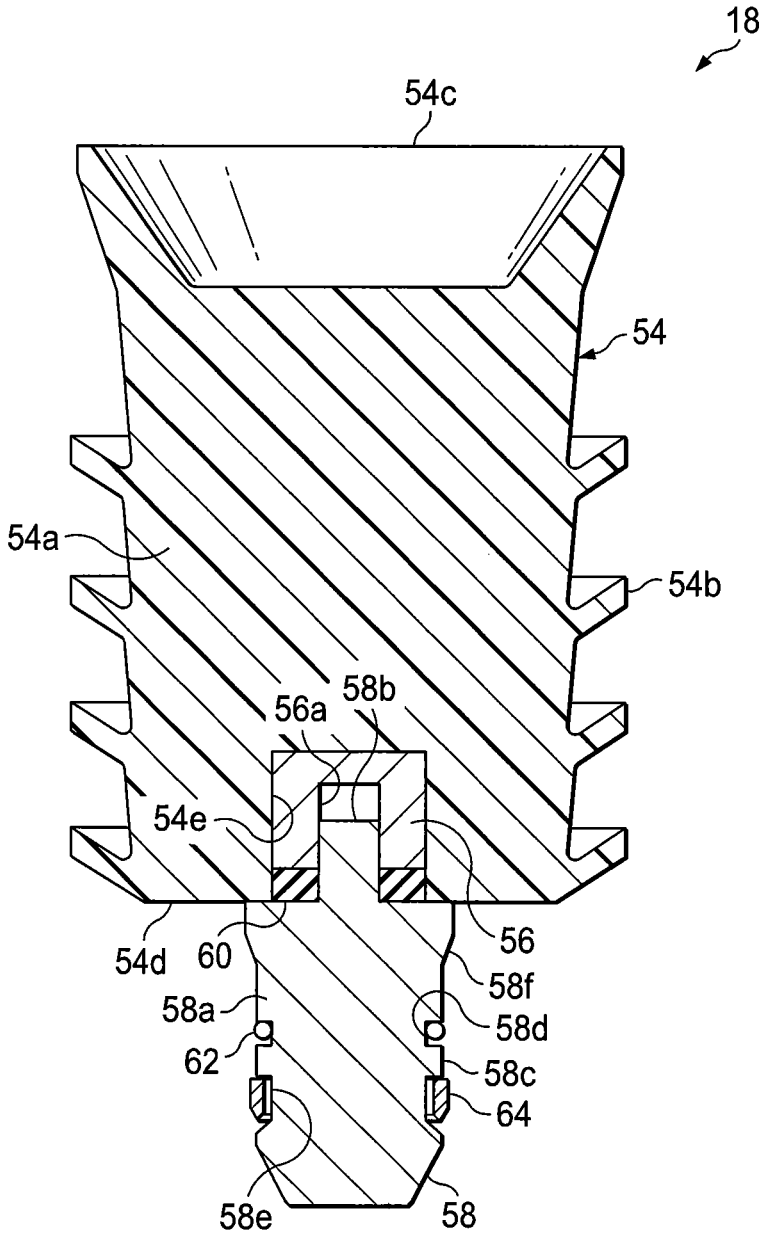
FIG. 5 is a sectional view of the top plug of FIG. 1 according to an exemplary embodiment.

In an exemplary embodiment, as illustrated in FIG. 5 with continuing reference to FIGS. 1, 2, 3, 3A, 3B, the top plug 18 includes a plug element 54, an insert 56, a nose 58, an annular spacer 60, an annular sealing element 62, and a snap ring 64.

The plug element 54 includes a generally cylindrical body 54*a*, a plurality of axially-spaced wipers 54*b* extending radially outward from, and circumferentially around, the generally cylindrical body 54*a*, and opposing ends 54*c* and 54*d*. A bore 54*e* is formed in the end 54*d*, and extends axially upward.

The insert 56 is disposed in the bore 54*e* of the plug element 54, and includes a bore 56*a* formed therein that extends axially upward and is generally coaxial with the bore 54*e*.

The nose 58 includes a generally cylindrical body 58*a* from which a cylindrical protrusion 58*b* extends axially upward and into the bore 56*a* of the insert 56 so that generally cylindrical body 58*a* abuts the end 54*d* of the plug element 54. A cylindrical surface 58*c* is defined by the generally cylindrical body 58*a*. An annular groove 58*d* is formed in the cylindrical surface 58*c*, and is axially positioned between the cylindrical protrusion 58*b* and the end of the nose 58 opposing the end 54*d* of the plug element 54. An annular channel 58*e* is formed in the cylindrical surface 58*c*, and is axially positioned between the annular groove 58*d* and the end of the nose 58 opposing the end 54*d* of the plug element 54. Except for any dimensional variations, the annular channel 58*e* is identical to the annular channel 24*g* and therefore the annular channel 58*e* will not be described in detail. An external tapered surface 58*f* is defined by the nose 58 and is axially positioned between the cylindrical protrusion 58*b* and the cylindrical surface 58*c*.

The annular spacer 60 extends circumferentially around the cylindrical protrusion 58*b*, and axially between the nose 58 and the insert 56. In an exemplary embodiment, the cylindrical protrusion 58*b* extends through the annular spacer 60 and is connected to the insert 56 by adhesive, a threaded engagement, one or more mechanical fasteners, or any combination thereof.

The annular sealing element 62 extends within the annular groove 58*d*. The snap ring 64 extends within the annular channel 58*e*. Except for any dimensional variations, the snap ring 64 is identical to the snap ring 38 and therefore the snap ring 64 will not be described in detail.

Figure 6:
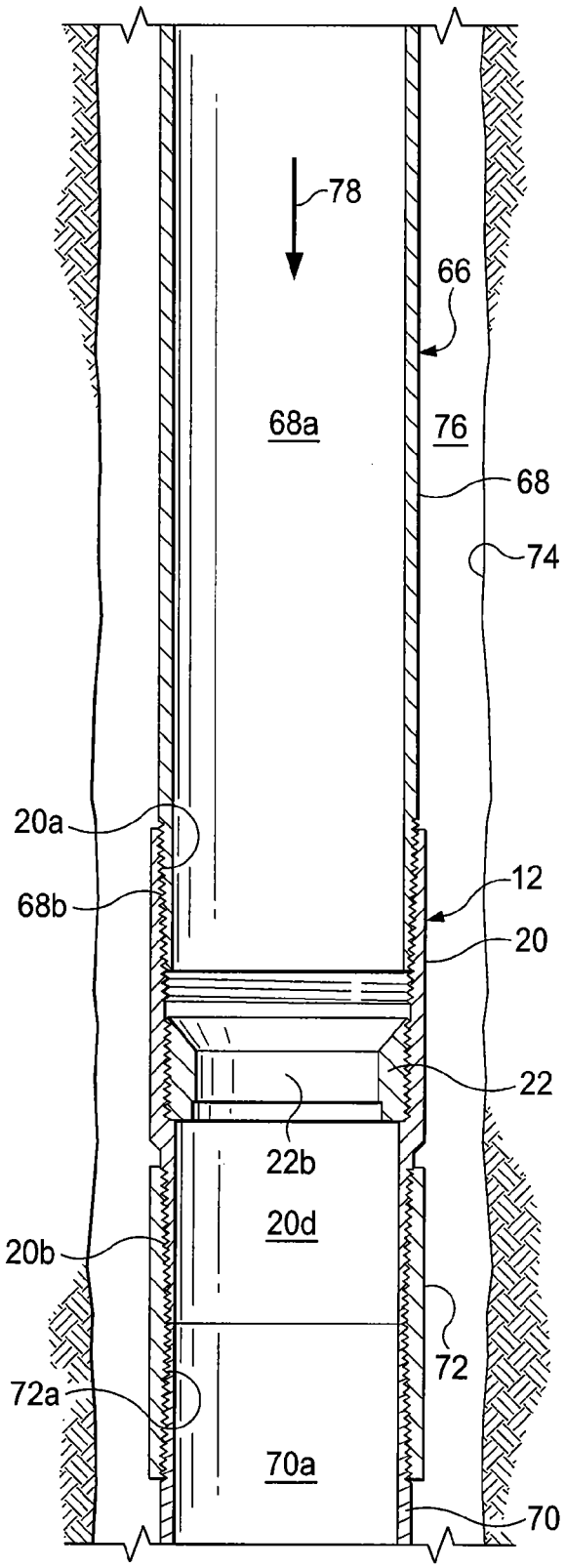
FIG. 6 is a sectional view of the landing collar of FIGS. 1 and 2 extending within a wellbore, according to an exemplary embodiment.

In operation, in an exemplary embodiment, as illustrated in FIG. 6 with continuing reference to FIGS. 1, 2, 3, 3A, 3B, 4 and 5, the sub 20 of the landing collar assembly 12 is part of a tubular string, such as a casing 66, which includes tubular support members 68 and 70. Internal passages 68*a* and 70*a* are defined by the tubular support members 68 and 70, respectively. An external threaded connection 68*b* of the tubular support member 68 is threadably engaged with the internal threaded connection 20*a*, thereby connecting the tubular support member 68 to the landing collar assembly 12 so that the internal passage 68*a* is in fluid communication with the internal passages 22*b* and 20*d*. An internal threaded connection 72*a* of a coupling 72 is threadably engaged with each of the external threaded connection 20*b* of the landing collar assembly 12 and an external threaded connection 70*b* of the tubular support member 70, thereby connecting the landing collar assembly 12 to the tubular support member 70 so that the internal passage 20*d* is in fluid communication with the internal passage 70*a*. As a result, as shown in FIG. 6, the collar 22 is disposed within, and connected to, the casing 66. In an exemplary embodiment, the coupling 72 may be omitted, the tubular support member 70 may include an internal threaded connection instead of the external threaded connection 70*b*, and this internal threaded connection may be threadably engaged with the external threaded connection 20*b* to thereby directly connect the tubular support member 70 to the landing collar assembly 12. In an exemplary embodiment, the coupling 72 and the sub 20 may be omitted, and the collar 22 may be disposed within, and directly connected to, one of the tubular support members 68 and 70. In an exemplary embodiment, the collar 22 may be connected to the casing 66 by being integrally formed with the sub 20, the tubular support member 68, or the tubular support member 70.

In several exemplary embodiments, the landing collar assembly 12 may be placed anywhere along the casing 66. In an exemplary embodiment, the tubular support member 70 is the bottommost tubular support member in the casing 66. In an exemplary embodiment, the landing collar assembly 12 may be connected to the distal end of the casing 66.

As shown in FIG. 6, the casing 66 is run in, or positioned within, a preexisting structure such as, for example, a wellbore 74 that traverses one or more subterranean formations, thereby radially defining an annular region 76 between the inside wall of the wellbore and the respective outside surfaces of the casing 66.

In an exemplary embodiment, before, during or after the positioning of the landing collar assembly 12 within the wellbore 74, fluidic materials 78 are injected into and circulated through the casing 66 via the internal passages 68*a*, 22*b*, 20*d* and 70*a*. In an exemplary embodiment, the fluidic materials 78 may be circulated through and out of the casing 66 and into the wellbore 74. In several exemplary embodiments, the fluidic materials 78 may include drilling fluids, drilling mud, water, other types of fluidic materials, or any combination thereof.

Figure 7:
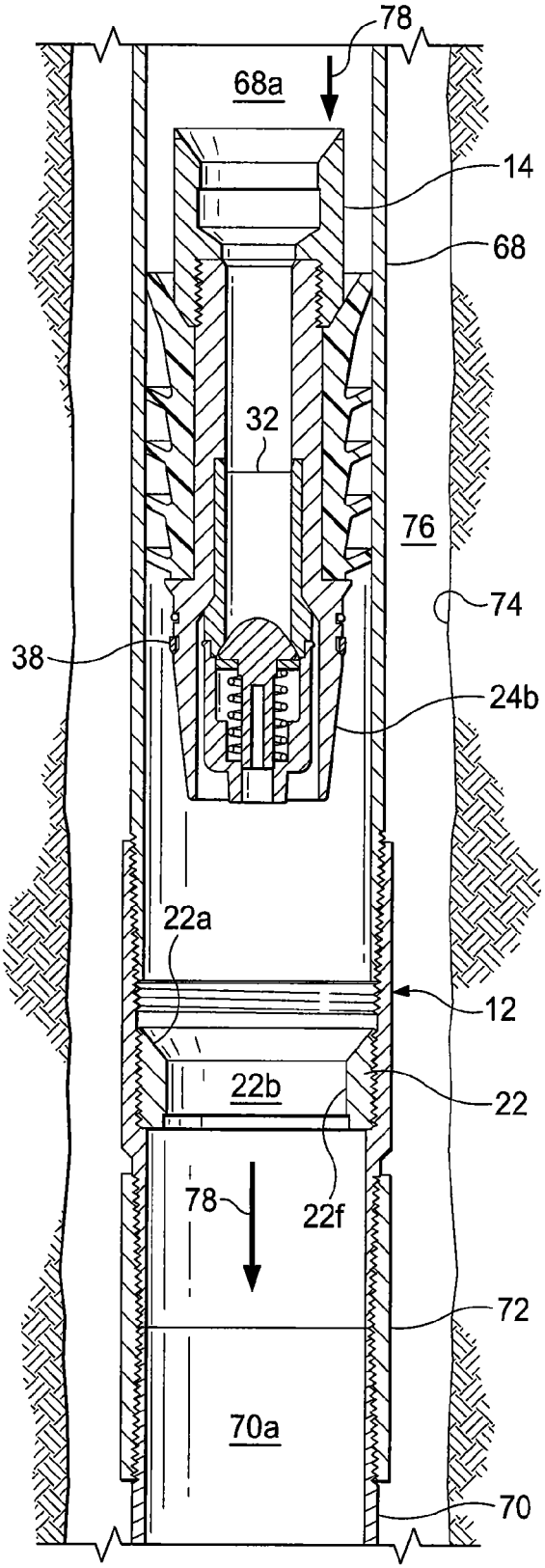
FIG. 7 is a sectional view of the valve assembly of FIGS. 1, 3, 3A and 3B being pumped toward the landing collar of FIGS. 1 and 2, according to an exemplary embodiment.
Figure 8:
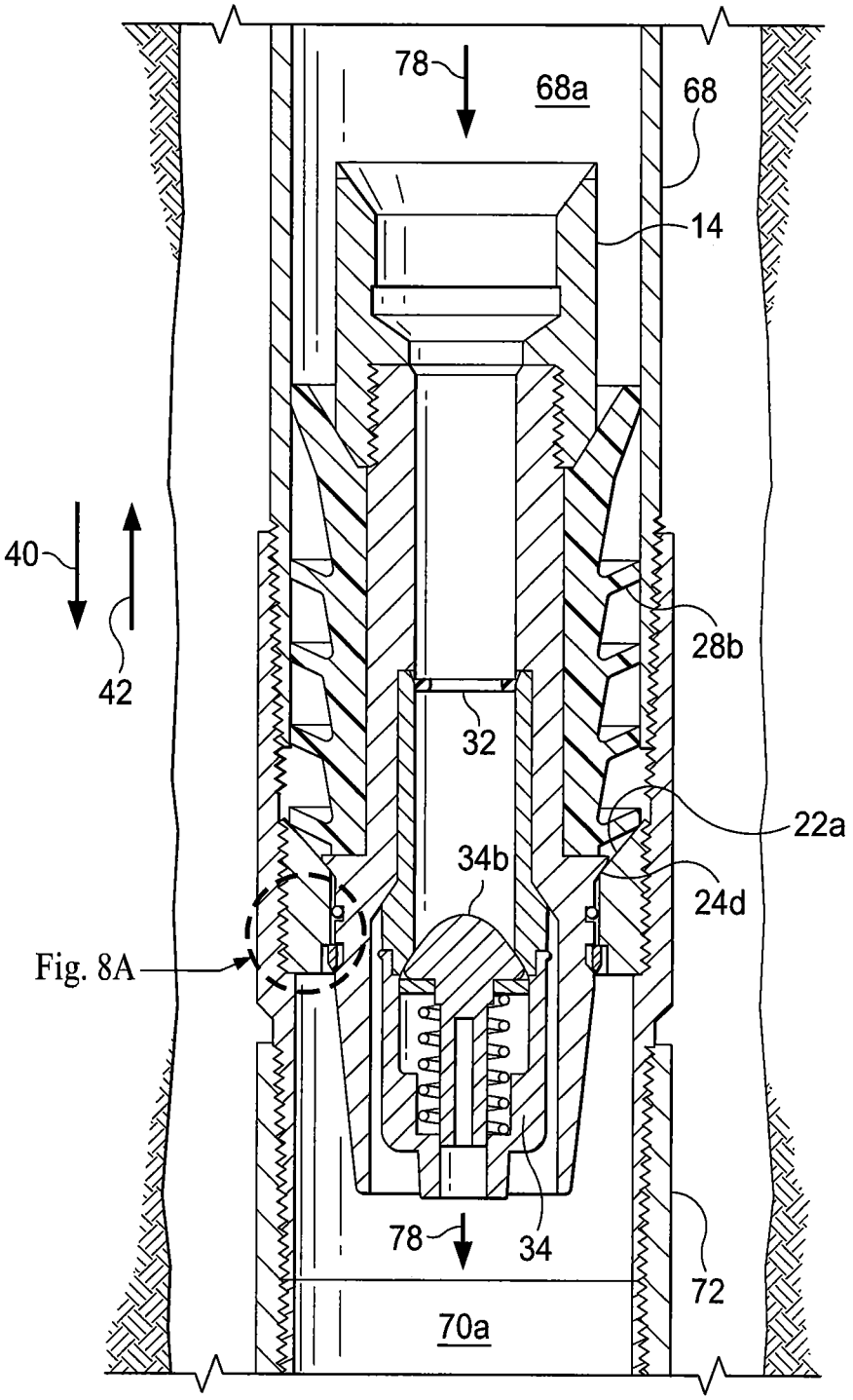
FIG. 8 is a sectional view of the valve assembly of FIGS. 1, 3, 3A and 3B engaged with the landing collar of FIGS. 1 and 2, according to an exemplary embodiment.
Figure 8A:
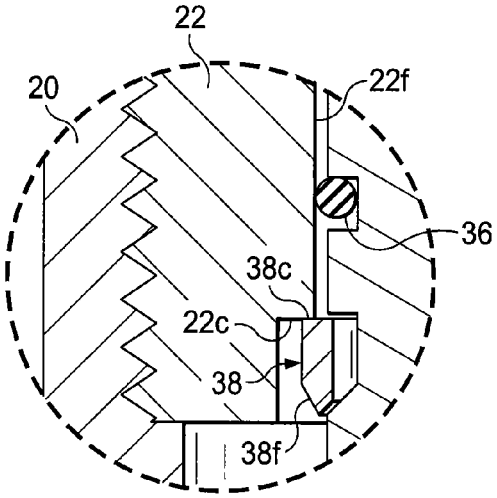
FIG. 8A is an enlarged view of a portion of FIG. 8, according to an exemplary embodiment.

In an exemplary embodiment, as illustrated in FIGS. 7, 8 and 8A with continuing references to FIGS. 1, 2, 3, 3A, 3B, 4, 5 and 6, before, during or after the injection of the fluidic materials 78, the valve assembly 14 is launched or injected into the casing 66 through at least the internal passage 68*a*, as shown in FIG. 7. The valve assembly 14 is able to be injected into, and pumped through, the casing 66 due to the rupture disc 32, against which a pressure is applied by the fluidic materials 78 to force the valve assembly 14 to flow downwards, as viewed in FIG. 7. The valve assembly 14 moves through the casing 66, relative to the landing collar assembly 12 and thus to the collar 22, until the externally tapered end portion 24*b* of the outside tubular member 24 moves through the internal passage 22*b* of the collar 22 and the valve assembly 14 is secured to the landing collar assembly 12 using the snap ring 38, as shown in FIG. 8. More particularly, as the valve assembly 14 moves downward as viewed in FIGS. 7 and 8, in the direction indicated by the arrow 40, the external tapered surface 38*f* of the snap ring 38 engages and slides against the internal tapered surface 22*a* of the collar 22, causing the snap ring 38 to radially compress. The break 38*b* permits the snap ring 38 to radially compress. As the snap ring 38 radially compresses, the external tapered surface 38*f* slides upward against the frusto-conical surface 24*m*, the axially-extending surface 38*d* may engage the axially-extending surface 24*l*, and the axially-facing surface 38*c* may engage the axially-facing surface 24*k*.

After engaging and sliding against the internal tapered surface 22*a* of the collar 22, the snap ring 38 engages and slides downward against the axially-extending surface 22*f* of the collar 22 until the snap ring 38 moves past the axially-extending surface 22*f* and the internal shoulder 22*c*, at which point the snap ring 38 radially expands due to the internal shoulder 22*c*. As shown in FIG. 8, the external tapered surface 24*d* engages the internal tapered surface 22*a*, preventing further downward movement of the valve assembly 14. As shown in FIG. 8A, the valve assembly 14 is prevented from moving upward because of the radial expansion of the snap ring 38 and the engagement of the axially-facing surface 38*c* with the internal shoulder 22*c*. As a result, the valve assembly 14 is secured or latched to the landing collar assembly 12 so that the valve assembly 14 extends entirely within the casing 66 (and thus the wellbore 74) and is prevented from moving, relative to the collar 22, in the respective directions indicated by the arrows 40 and 42. As shown in FIGS. 8 and 8A, the annular sealing element 36 sealingly engages the axially-extending surface 22*f* of the collar 22. The wipers 28*b* sealingly engage at least the inside surface of the tubular support member 68. To secure or latch the valve assembly 14 to the landing collar assembly 12 in accordance with the foregoing, the pressure applied by the fluidic materials 78 against the rupture disc 32 may be increased to a level that is still less than the pressure level required to rupture the rupture disc 32.

After the valve assembly 14 has been secured to the landing collar assembly 12, the fluidic materials 78 continue to be injected into the casing 66, pressurizing the fluid materials 78 in the internal passage 24*i* until the rupture disc 32 ruptures, or an opening is formed through the rupture disc 32. The fluid materials 78 are now permitted to flow into the internal passage 30*a*. The valve element 34*b* permits the fluidic materials 78 to flow through the internal passage 30*a* of the inside tubular member 30 in the direction indicated by the arrow 40, and prevents the fluidic materials 78 from flowing back into the internal passage 30*a* via the opening 30*f* in the direction indicated by the arrow 42. In an exemplary embodiment, after the valve assembly 14 is secured to the landing collar assembly 12 and the rupture disc 32 is ruptured, the operation of the valve assembly 14 may be characterized as the operation of a float collar with check valve.

As noted above, in several exemplary embodiments, the landing collar assembly 12 may be placed anywhere along the casing 66. In an exemplary embodiment, the landing collar assembly 12 may be connected to the distal end of the casing 66 so that only a portion of the valve assembly 14 extends within the casing 66. In an exemplary embodiment, the landing collar assembly 12 may be sized, and connected to the casing 66, so that the valve assembly 14 does not extend within the casing 66.

In an exemplary embodiment, after the securement of the valve assembly 14 to the landing collar assembly 12 and the rupture of the rupture disc 32, the fluidic materials 78 continue to be injected into and circulated through the casing 66 via at least the internal passages 68*a*, 26*f*, 24*i*, and 30*a*, the one-way valve 34, and the internal passages 20*d* and 70*a*. In an exemplary embodiment, the fluidic materials 78 may be circulated through and out of the casing 66, into the wellbore 74, and up through the annular region 76. In an exemplary embodiment, the fluidic materials 78 are so circulated to clean the casing 66, the wellbore 74 and the annular region 76 before commencing subsequent operations within the wellbore 74 such as, for example, subsequent cementing operations.

Figure 9:
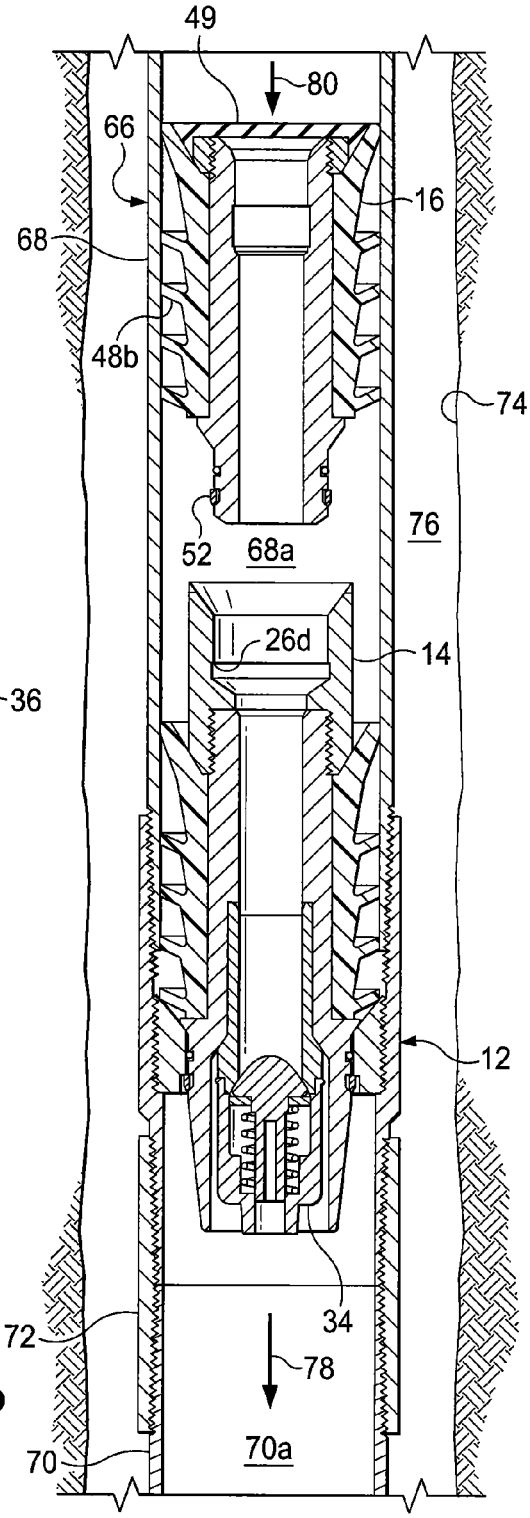
FIG. 9 is a view similar to that of FIG. 8, but also illustrating the bottom plug of FIGS. 1 and 4 being pumped toward the valve assembly of FIGS. 1, 3, 3A and 3B, according to an exemplary embodiment.
Figure 10:
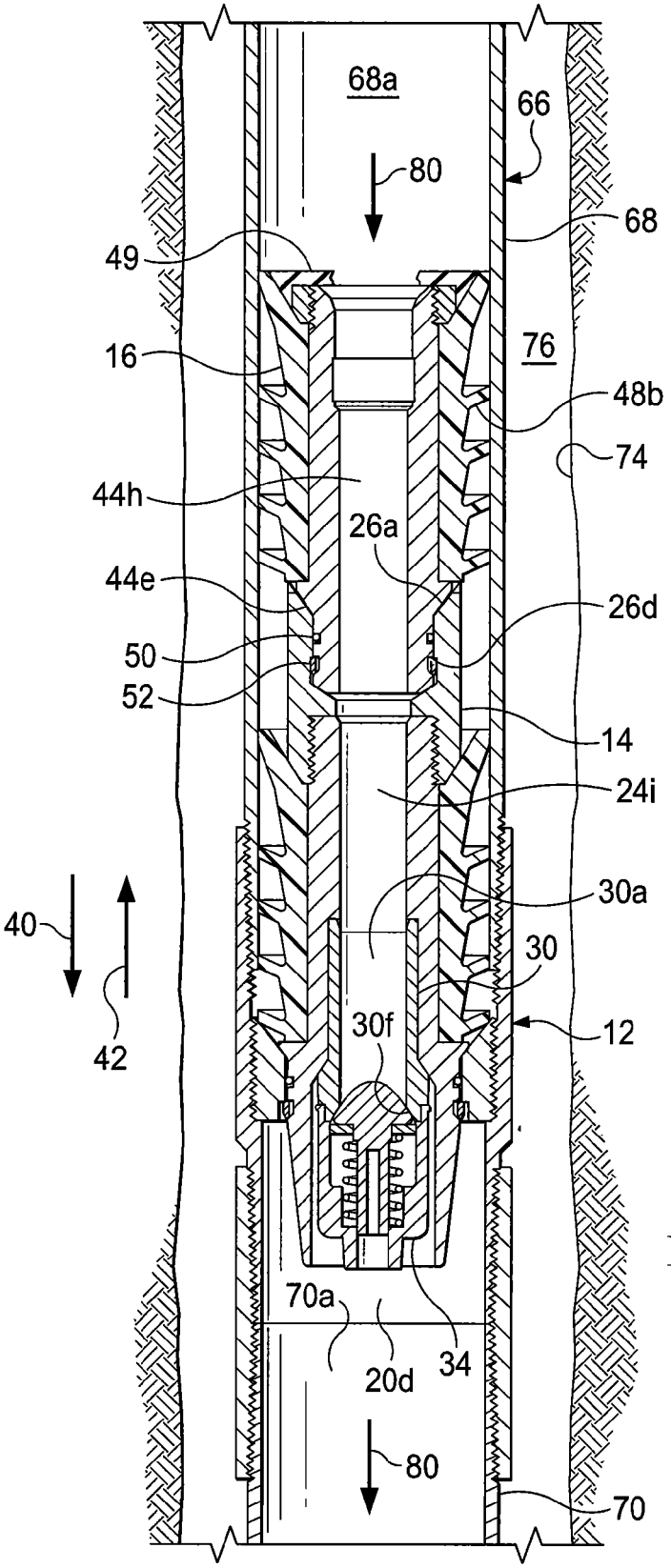
FIG. 10 is a view similar to that of FIG. 9, but illustrating the bottom plug of FIGS. 1 and 4 engaged with the valve assembly of FIGS. 1, 3, 3A and 3B, according to an exemplary embodiment.

In an exemplary embodiment, as illustrated in FIGS. 9 and 10 with continuing references to FIGS. 1, 2, 3, 3A, 3B, 4, 5, 6, 7, 8 and 8A, before, during or after the injection of the fluidic materials 78, the bottom plug 16 is launched or injected into the casing 66 through at least the internal passage 68*a*, as shown in FIG. 9. As the bottom plug 16 moves towards the valve assembly 14, the wipers 48*b* of the bottom plug 16 wipe the respective inside surfaces of the casing 66, further cleaning the casing 66.

As shown in FIG. 9, after the bottom plug 16 is launched or injected into the casing 66 through at least the internal passage 68*a*, another fluidic material, such as a hardenable fluidic material 80, is injected into the casing 66 and follows the bottom plug 16 towards the valve assembly 14. In an exemplary embodiment, the hardenable fluidic material 80 is, or includes, cement.

The bottom plug 16 is able to be injected into, and pumped through, the casing 66 due to the rupture disc 49, against which a pressure is applied by the fluidic materials 78 and/or 80 to force the bottom plug 16 to flow downwards, as viewed in FIG. 9.

The bottom plug 16 moves through the casing 66 until the snap ring 52 of the bottom plug 16 moves past the internal shoulder 26*d* of the valve assembly 14. The bottom plug 16 is then latched or secured to the valve assembly 14, using the snap ring 52 and the external tapered surface 44*e*, in a manner that is identical to the above-described manner in which the valve assembly 14 is latched or secured to the landing collar assembly 12, using the snap ring 38 and the external tapered surface 24*d*. As a result, as shown in FIG. 10, the snap ring 52 engages the internal shoulder 26*d*, the external tapered surface 44*e* engages the internal tapered surface 26*a*, the annular sealing element 50 sealingly engages the axially-extending surface 26*h*, and the wipers 48*b* sealing engage at least the inside surface of the tubular support member 68.

As shown in FIG. 10, after the bottom plug 16 has been secured to the valve assembly 14, the hardenable fluidic material 80 continues to be injected into the casing 66, pressurizing the hardenable fluidic material 80 in the internal passage 68*a* until the rupture disc 49 ruptures, or an opening is formed through the rupture disc 49. The hardenable fluidic material 80 is now permitted to flow through the internal passage 44*h*, and does flow through at least the internal passages 68*a*, 44*h*, 26*f*, 24*i* and 30*a*, the one-way valve 34, and the internal passages 20*d* and 70*a*. The valve element 34*b* permits the hardenable fluidic material 80 to flow through the internal passage 30*a* of the inside tubular member 30 in the direction indicated by the arrow 40, and prevents the hardenable fluidic material 80 from flowing back into the internal passage 30*a* via the opening 30*f* in the direction indicated by the arrow 42. Thus, the one-way valve 34 permits fluid flow in the direction indicated by the arrow 40 through any of the tubular members of the valve assembly 14, but prevents fluid flow therethrough in the direction indicated by the arrow 42.

In an exemplary embodiment, after the securement of the bottom plug 16 to the valve assembly 14 and the rupture of the rupture disc 49, the hardenable fluidic material 80 continues to be injected into and circulated through the casing 66 via at least the internal passages 68*a*, 44*h*, 26*f*, 24*i*, and 30*a*, the one-way valve 34, and the internal passages 20*d* and 70*a*. In an exemplary embodiment, the hardenable fluidic material 80 flows out of the casing 66 and into the annular region 76. As a result, an annular body of the hardenable fluidic material 80 is formed within the annular region 76. After the curing of the annular body of the hardenable fluidic material 80 within the annular region 76, the casing 66 is better supported within the wellbore 74, and the portion of the annular region 76 or any formation below the annular body of the hardenable fluidic material 80 is fluidically isolated from the portion of the annular region 76 or any formation above the annular body of the hardenable fluidic material 80. In several exemplary embodiments, the improved support of the casing 66, or the fluidic isolation of the portion of the annular region 76 or any formation above the annular body of the hardenable fluidic material 80 from the portion of the annular region 76 or any formation below the annular body, facilitates oil and gas exploration or production operations subsequent to the operation of the apparatus 10, as described above and below. In an exemplary embodiment, the hardenable fluidic material 80 is, or includes, cement, and the completion of forming (and subsequently curing) the annular body of the hardenable fluidic material 80 is the completion of one stage in the stage cementing of the casing 66 in the wellbore 74.

Figure 11:
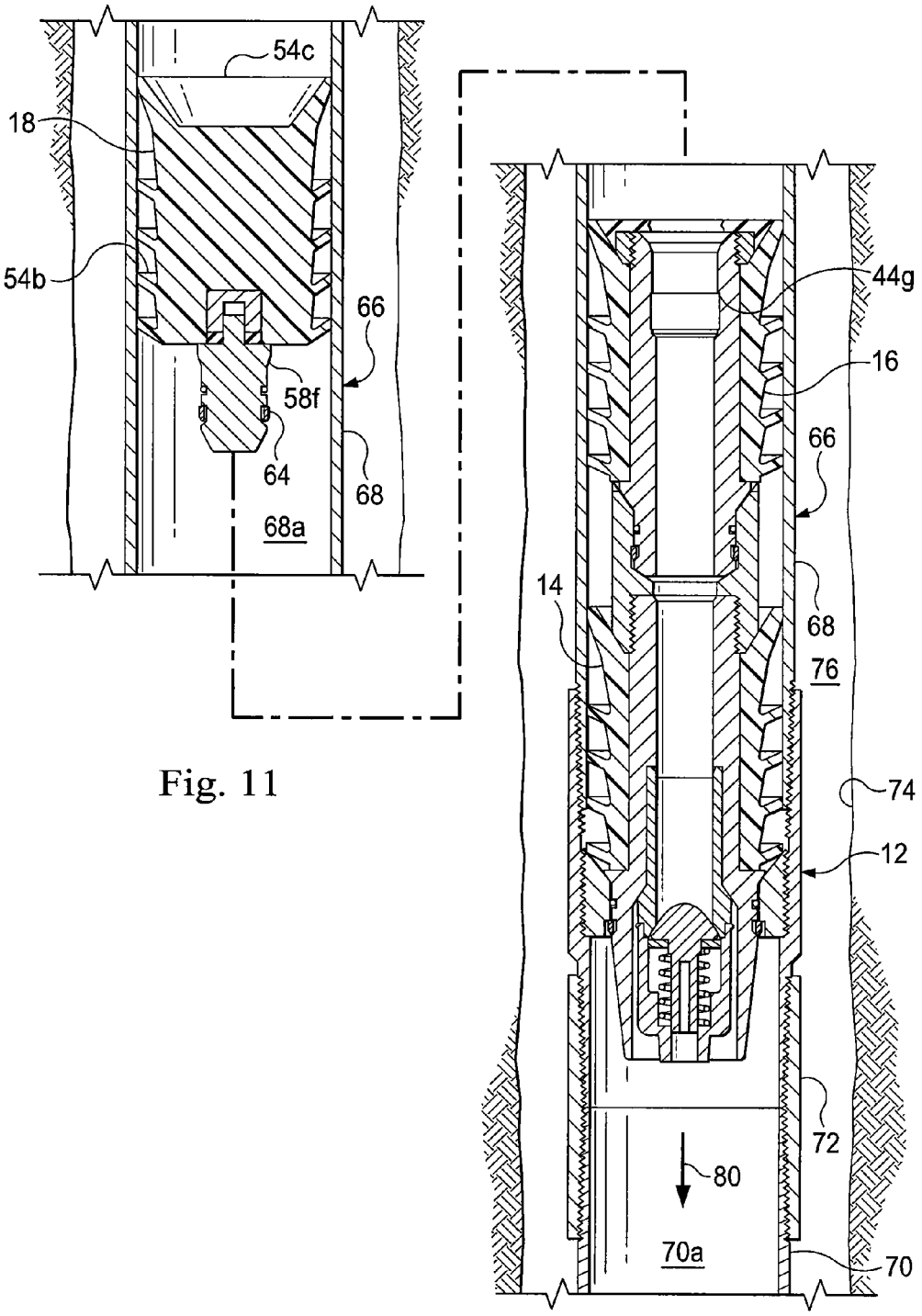
FIG. 11 is a view similar to that of FIG. 10, but also illustrating the top plug of FIGS. 1 and 5 being pumped toward the bottom plug of FIGS. 1 and 4, according to an exemplary embodiment.
Figure 12:
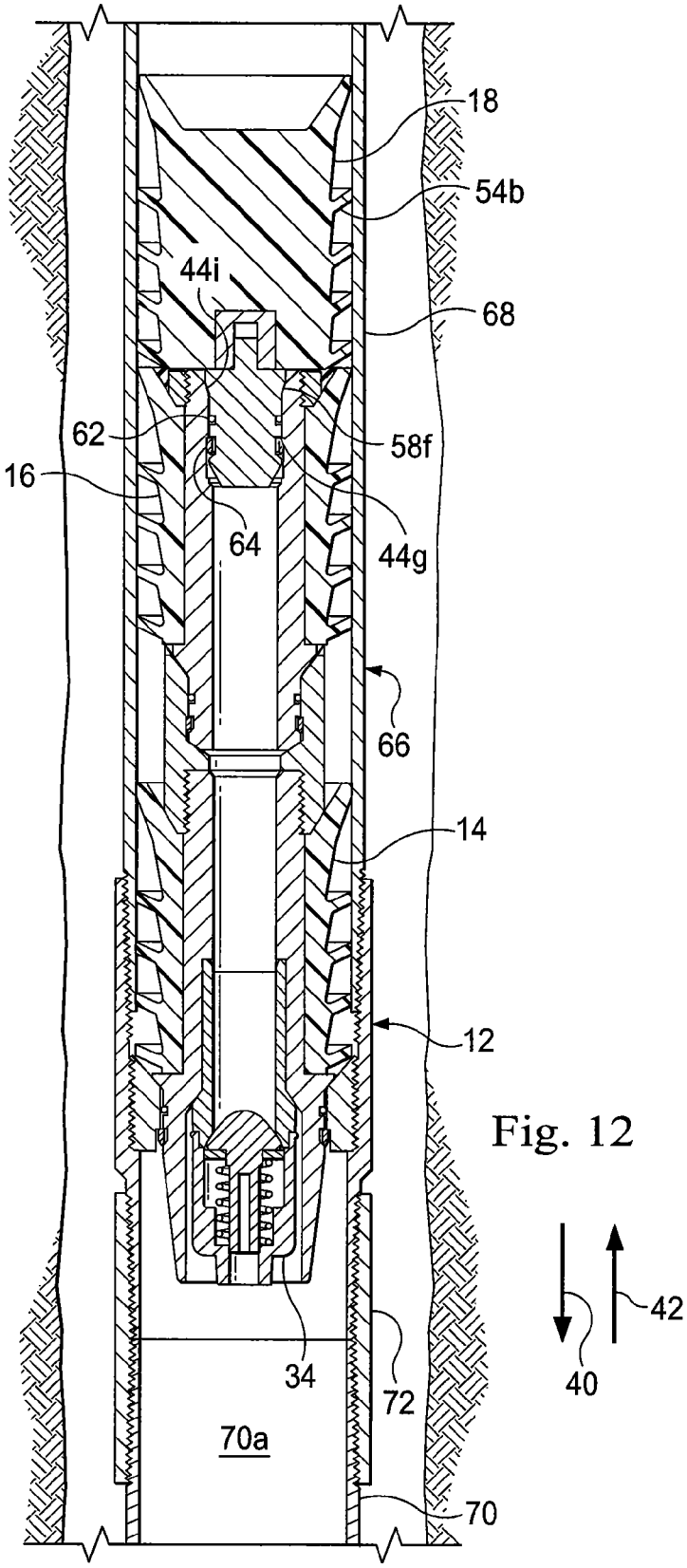
FIG. 12 is a view similar to that of FIG. 11, but illustrating the top plug of FIGS. 1 and 5 engaged with the bottom plug of FIGS. 1 and 4, according to an exemplary embodiment.

In an exemplary embodiment, as illustrated in FIGS. 11 and 12 with continuing references to FIGS. 1, 2, 3, 3A, 3B, 4, 5, 6, 7, 8, 8A, 9 and 10, before, during or after the curing of the annular body of the hardenable fluidic material 80, the top plug 18 is launched or injected into the casing 66 through at least the internal passage 68*a*, as shown in FIG. 11. In several exemplary embodiments, the hardenable fluidic material 80, the fluidic materials 78, other fluidic materials, or any combination thereof, may be used to apply a pressure against the end 54*c* of the plug element 54, thereby forcing the top plug 18 to flow downwards, as viewed in FIG. 11.

As the top plug 18 moves through the casing 66, the wipers 54*b* wipe the hardenable fluidic material 80 from the respective inside surfaces of the casing 66.

The top plug 18 moves through the casing 66 until the snap ring 64 moves past the internal shoulder 44*g* of the bottom plug 16. The top plug 18 is then latched or secured to the bottom plug 16, using the snap ring 64 and the external tapered surface 58*f*, in a manner that is identical to the above-described manner in which the valve assembly 14 is latched or secured to the landing collar assembly 12, using the snap ring 38 and the external tapered, surface 24*d*. As a result, as shown in FIG. 12, the snap ring 64 engages the internal shoulder 44*g*, the external tapered surface 58*f* engages the internal tapered surface 44*i*, the annular sealing element 62 sealingly engages the axially-extending surface 44*j*, and the wipers 54*b* sealing engage at least the inside surface of the tubular support member 68. The top plug 18 is secured to the bottom plug 16 and thus is secured to the valve assembly 14 via the bottom plug 16.

As shown in FIG. 12, after the top plug 18 has been secured to the bottom plug 16 and thus to the valve assembly 14 via the bottom plug 16, the apparatus 10 plugs the casing 66, preventing fluid flow therethrough in the respective directions indicated by the arrows 40 and 42. As discussed above, the one-way valve 34 prevents fluid from flowing within the casing 66 in the direction 42. The top plug 18, the above-described securement of the top plug 18 to the bottom plug 16, the above-described securement of the bottom plug 16 to the valve assembly 14, and the above-described securement of the valve assembly 14 to the landing collar assembly 12, assist in providing a secondary backup to the one-way valve 34. More particularly, during operation, if the one-way valve 34 malfunctions in some way and thus permits fluid flow in the direction indicated by the arrow 42, the top plug 18 secondarily prevents fluid flow through the casing 66 in the direction indicated by the arrow 42. The respective securements of the top plug 18 to the bottom plug 16, the bottom plug 16 to the valve assembly 14, and the valve assembly 14 to the landing collar assembly 12, facilitate maintaining the position of the top plug 18 within the casing 66, thereby enabling the top plug 18 to secondarily prevent fluid flow in the direction indicated by the arrow 42.

In an exemplary embodiment, after the apparatus 10 has been placed in the configuration illustrated in FIG. 12, a drill-out operation occurs during which at least respective portions of the top plug 18, the bottom plug 16 and the valve assembly 14 are drilled out.

In several exemplary embodiments, referring back to FIG. 6, since the valve assembly 14 is not disposed within the casing 66 during the initial positioning of the casing 66 within the wellbore 74, the casing 66 can be run in the wellbore 74 "wide open," that is, without a significant obstruction within the casing 66, thereby facilitating the positioning of the casing 66 within the wellbore 74.

In several exemplary embodiments, referring back to FIG. 6, the casing 66 may be run in, or positioned within, the wellbore 74 without a float shoe, float collar or one-way valve positioned within the casing 66. Instead, in several exemplary embodiments, the valve assembly 14 is latched or secured to the landing collar assembly 12 after the casing 66 has been positioned within the wellbore. Running or positioning the casing 66, without a float shoe, float collar or one-way valve positioned therewithin, eliminates, or at least reduces, the risk of surge pressures creating unwanted fractures in the formations through which the wellbore 74 extends.

In several exemplary embodiments, the option to not use the apparatus 10 is available. More particularly, before operating the apparatus 10 in accordance with the foregoing, the plugging of the casing 66 with the apparatus 10 may not be desired or needed. If so, then the valve assembly 14 is not launched or injected into the casing 66, and the landing collar assembly 12 is not used. However, although the landing collar assembly 12 is still part of the casing 66, the landing collar assembly 12 does not affect other operations involving the casing 66.

In several exemplary embodiments, one or more additional landing collar assemblies, each of which is substantially similar to the landing collar assembly 12, are part of, or are added to, the casing 66. In several exemplary embodiments, one or more additional apparatuses, each of which is substantially similar to the apparatus 10, may be used to complete one or more additional stages, respectively, in the stage cementing of the casing 66 within the wellbore 74.

An apparatus has been described that includes a collar adapted to be disposed within, and connected to, a tubular string; a valve assembly, including a first tubular member; and a valve connected to the first tubular member, wherein the valve permits fluid flow through the first tubular member in a first direction and prevents fluid flow through the first tubular member in a second direction that is opposite the first direction; wherein the valve assembly is adapted to be secured to the collar so that the valve assembly is prevented from moving, relative to the collar, in the first and second directions; and a first plug adapted to be secured to the valve assembly so that the first plug is prevented from moving, relative to the valve assembly, in the first and second directions. In an exemplary embodiment, the apparatus plugs the tubular string so that fluid flow through the tubular string is not permitted when the collar is disposed within, and connected to, the tubular string; the valve assembly is secured to the collar so that the valve assembly is prevented from moving, relative to the collar, in the first and second directions; and the first plug is secured to the valve assembly so that the first plug is prevented from moving, relative to the valve assembly, in the first and second directions. In an exemplary embodiment, the valve assembly is secured to the collar in response to relative movement between the collar and the valve assembly in the first direction or the second direction; and wherein the first plug is secured to the valve assembly in response to relative movement between the valve assembly and the first plug in the first direction or the second direction. In an exemplary embodiment, the collar includes an internal shoulder; and wherein the valve assembly is secured to the collar in response to movement of a portion of the first tubular member in the first direction and past the internal shoulder. In an exemplary embodiment, the first plug includes a generally cylindrical body; and a plurality of axially-spaced wipers extending radially outward from, and circumferentially around, the generally cylindrical body. In an exemplary embodiment, the first plug includes a second tubular member; and a wiper element including a tubular body through which the second tubular member extends, and a plurality of axially-spaced wipers extending radially outward from, and circumferentially around, the tubular body; wherein the valve assembly includes an internal shoulder; and wherein the first plug is secured to the valve assembly in response to movement of a portion of the second tubular member in the first direction and past the internal shoulder. In an exemplary embodiment, the apparatus includes a second plug adapted to be secured to the valve assembly so that the second plug is prevented from moving, relative to the valve assembly, in the first and second directions; wherein the first plug is adapted to be secured to the second plug, and thus to the valve assembly via the second plug, so that the first plug is prevented from moving, relative to each of the valve assembly and the second plug, in the first and second directions; wherein the apparatus plugs the tubular string so that fluid flow through the tubular string is not permitted when the collar is disposed within, and connected to, the tubular string; the valve assembly is secured to the collar so that the valve assembly is prevented from moving, relative to the collar, in the first and second directions; the second plug is secured to the valve assembly so that the second plug is prevented from moving, relative to the valve assembly, in the first and second directions; the first plug is secured to the second plug, and thus to the valve assembly via the second plug, so that the first plug is prevented from moving, relative to each of the valve assembly and the second plug, in the first and second directions. In an exemplary embodiment, the first plug includes a generally cylindrical body; and a first plurality of axially-spaced wipers extending radially outward from, and circumferentially around, the generally cylindrical body; and wherein the second plug includes a second tubular member; and a wiper element including a tubular body through which the second tubular member extends, and a second plurality of axially-spaced wipers extending radially outward from, and circumferentially around, the tubular body.

An apparatus has been described that includes a valve assembly, including a first tubular member; and a valve connected to the first tubular member, wherein the valve permits fluid flow through the first tubular member in a first direction and prevents fluid flow through the first tubular member in a second direction that is opposite the first direction; and a first plug adapted to be secured to the valve assembly so that the first plug is prevented from moving, relative to the valve assembly, in the first and second directions; wherein the first plug is secured to the valve assembly in response to relative movement between the valve assembly and the first plug in the first direction or the second direction. In an exemplary embodiment, the first plug includes a generally cylindrical body; and a plurality of axially-spaced wipers extending radially outward from, and circumferentially around, the generally cylindrical body. In an exemplary embodiment, the first plug includes a second tubular member; and a wiper element including a tubular body through which the second tubular member extends, and a plurality of axially-spaced wipers extending radially outward from, and circumferentially around, the tubular body; wherein the valve assembly includes an internal shoulder; and wherein the first plug is secured to the valve assembly in response to movement of a portion of the second tubular member in the first direction and past the internal shoulder. In an exemplary embodiment, the apparatus includes a second plug adapted to be secured to the valve assembly so that the second plug is prevented from moving, relative to the valve assembly, in the first and second directions; wherein the first plug is adapted to be secured to the second plug, and thus to the valve assembly via the second plug, so that the first plug is prevented from moving, relative to each of the valve assembly and the second plug, in the first and second directions. In an exemplary embodiment, the first plug includes a generally cylindrical body; and a first plurality of axially-spaced wipers extending radially outward from, and circumferentially around, the generally cylindrical body; wherein the second plug includes a second tubular member; and a wiper element including a tubular body through which the second tubular member extends, and a second plurality of axially-spaced wipers extending radially outward from, and circumferentially around, the tubular body; wherein the valve assembly includes an internal shoulder; and wherein the second plug is secured to the valve assembly in response to movement of a portion of the second tubular member in the first direction and past the internal shoulder.

A method has been described that includes positioning a casing within a wellbore that traverses a subterranean formation; during or after positioning the casing within the wellbore, securing a valve assembly to the casing so that: the valve assembly extends entirely within the casing and the wellbore, and the valve assembly is prevented from moving relative to the casing; permitting, using the valve assembly, fluid flow through the casing in a first direction; and preventing, using the valve assembly, fluid flow through the casing in a second direction that is opposite the first direction. In an exemplary embodiment, the method includes connecting a collar to the casing; wherein securing the valve assembly to the casing comprises injecting the valve assembly into the casing so that the valve assembly moves in the first direction towards, and relative to, the collar; and wherein the valve assembly is secured to the collar, and thus to the casing, in response to the relative movement between the valve assembly and the collar. In an exemplary embodiment, the method includes securing a first plug to the valve assembly so that: the first plug is prevented from moving, relative to the valve assembly, in the first and second directions, and fluid flow through the casing is prevented in each of the first and second directions. In an exemplary embodiment, securing the first plug to the valve assembly comprises securing a second plug to the valve assembly so that the second plug is prevented from moving, relative to the valve assembly, in the first and second directions; and securing the first plug to the second plug so that the first plug is secured to the valve assembly via the second plug and thus the first plug is prevented from moving, relative to each of the valve assembly and the second plug, in the first and second directions. In an exemplary embodiment, the method includes injecting a hardenable fluidic material into the casing so that the hardenable fluidic material flows in the first direction and through the valve assembly; forming an annular body of the hardenable fluidic material in an annular region that is radially defined between the wellbore and the casing; and securing a plug to the valve assembly so that: the first plug is prevented from moving, relative to the valve assembly, in the first and second directions, and fluid flow through the casing is prevented in each of the first and second directions.

A method has been described that includes providing a valve assembly, the valve assembly comprising a first tubular member; and a valve connected to the first tubular member, wherein the valve permits fluid flow through the first tubular member in a first direction and prevents fluid flow through the first tubular member in a second direction that is opposite the first direction; and securing a first plug to the valve assembly so that the first plug is prevented from moving, relative to the valve assembly, in the first and second directions, wherein the first plug is secured to the valve assembly in response to relative movement between the valve assembly and the first plug in the first direction or the second direction. In an exemplary embodiment, securing the first plug to the valve assembly comprises securing a second plug to the valve assembly so that the second plug is prevented from moving, relative to the valve assembly, in the first and second directions, wherein the second plug is secured to the valve assembly in response to relative movement between the valve assembly and the second plug in the first direction or the second direction; and securing the first plug to the second plug so that the first plug is secured to the valve assembly via the second plug and thus the first plug is prevented from moving, relative to each of the valve assembly and the second plug, in the first and second directions, wherein the first plug is secured to the second plug in response to the relative movement between the valve assembly and the first plug in the first direction or the second direction. In an exemplary embodiment, the method includes positioning a casing within a wellbore that traverses a subterranean formation; during or after positioning the casing within the wellbore, securing the valve assembly to the casing so that the valve assembly extends entirely within the casing and is prevented from moving relative thereto in the first and second directions; permitting, using the valve assembly, fluid flow through the casing in the first direction; and preventing, using the valve assembly, fluid flow through the casing in the second direction; wherein the first plug is secured to the valve assembly after the valve assembly is secured to the casing. In an exemplary embodiment, the method includes connecting a collar to the casing; wherein securing the valve assembly to the casing comprises injecting the valve assembly into the casing so that the valve assembly moves in the first direction towards, and relative to, the collar; and wherein the valve assembly is secured to the collar, and thus to the casing, in response to the relative movement between the valve assembly and the collar. In an exemplary embodiment, the method includes injecting a hardenable fluidic material into the casing so that the hardenable fluidic material flows in the first direction and through the valve assembly; forming an annular body of the hardenable fluidic material in an annular region that is radially defined between the wellbore and the casing. In an exemplary embodiment, fluid flow through the casing in the first and second directions is prevented in response to securing the first plug to the valve assembly. In an exemplary embodiment, the method includes securing a second plug to the first plug so that the second plug is prevented from moving, relative to the first plug, in the first and second directions. In an exemplary embodiment, the first plug comprises a second tubular member; and a wiper element comprising a tubular body through which the second tubular member extends, and a first plurality of axially-spaced wipers extending radially outward from, and circumferentially around, the tubular body; and wherein the second plug comprises a generally cylindrical body; and a first plurality of axially-spaced wipers extending radially outward from, and circumferentially around, the generally cylindrical body.

A system has been described that includes means for, during or after positioning a casing within a wellbore that traverses a subterranean formation, securing a valve assembly to the casing so that: the valve assembly extends entirely within the casing and the wellbore, and the valve assembly is prevented from moving relative to the casing; means for permitting fluid flow through the valve assembly, and thus through the casing, in a first direction; and means for preventing fluid flow through the valve assembly, and thus through the casing, in a second direction that is opposite the first direction. In an exemplary embodiment, the system includes means for securing a first plug to the valve assembly so that: the first plug is prevented from moving, relative to the valve assembly, in the first and second directions, and fluid flow through the casing is prevented in each of the first and second directions. In an exemplary embodiment, means for securing the first plug to the valve assembly comprises means for securing a second plug to the valve assembly so that the second plug is prevented from moving, relative to the valve assembly, in the first and second directions; and means for securing the first plug to the second plug so that the first plug is secured to the valve assembly via the second plug and thus the first plug is prevented from moving, relative to each of the valve assembly and the second plug, in the first and second directions.

A system has been described that includes a valve assembly, comprising a first tubular member; and a valve connected to the first tubular member, wherein the valve permits fluid flow through the first tubular member in a first direction and prevents fluid flow through the first tubular member in a second direction that is opposite the first direction; and means for securing a first plug to the valve assembly so that the first plug is prevented from moving, relative to the valve assembly, in the first and second directions, wherein the first plug is secured to the valve assembly in response to relative movement between the valve assembly and the first plug in the first direction or the second direction. In an exemplary embodiment, means for securing the first plug to the valve assembly comprises means for securing a second plug to the valve assembly so that the second plug is prevented from moving, relative to the valve assembly, in the first and second directions, wherein the second plug is secured to the valve assembly in response to relative movement between the valve assembly and the second plug in the first direction or the second direction; and means for securing the first plug to the second plug so that the first plug is secured to the valve assembly via the second plug and thus the first plug is prevented from moving, relative to each of the valve assembly and the second plug, in the first and second directions, wherein the first plug is secured to the second plug in response to the relative movement between the valve assembly and the first plug in the first direction or the second direction. In an exemplary embodiment, the system includes means for, during or after positioning a casing within a wellbore that traverses a subterranean formation, securing the valve assembly to the casing so that the valve assembly extends entirely within the casing and is prevented from moving relative thereto in the first and second directions; means for permitting fluid flow through the valve assembly, and thus through the casing, in a first direction; and means for preventing fluid flow through the valve assembly, and thus through the casing, in a second direction that is opposite the first direction. In an exemplary embodiment, the system includes means for securing a second plug to the first plug so that the second plug is prevented from moving, relative to the first plug, in the first and second directions. In an exemplary embodiment, the first plug comprises a second tubular member; and a wiper element comprising a tubular body through which the second tubular member extends, and a first plurality of axially-spaced wipers extending radially outward from, and circumferentially around, the tubular body; and wherein the second plug comprises a generally cylindrical body; and a first plurality of axially-spaced wipers extending radially outward from, and circumferentially around, the generally cylindrical body.

It is understood that variations may be made in the foregoing without departing from the scope of the disclosure. In several exemplary embodiments, the bottom plug 16 may be omitted from the apparatus 10, and the top plug 18 may be latched or secured to the valve assembly 14. In several exemplary embodiments, instead of the one-way valve 34, the valve assembly 14 may include another type of check valve or one-way valve.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, or one or more of the procedures may also be performed in different orders, simultaneously or sequentially. In several exemplary embodiments, the steps, processes or procedures may be merged into one or more steps, processes or procedures. In several exemplary embodiments, one or more of the operational steps in each embodiment may be omitted. Moreover, in some instances, some features of the present disclosure may be employed without a corresponding use of the other features. Moreover, one or more of the above-described embodiments or variations may be combined in whole or in part with any one or more of the other above-described embodiments or variations.

Although several exemplary embodiments have been described in detail above, the embodiments described are exemplary only and are not limiting, and those skilled in the art will readily appreciate that many other modifications, changes or substitutions are possible in the exemplary embodiments without materially departing from the novel teachings and advantages of the present disclosure. Accordingly, all such modifications, changes or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. An apparatus, comprising:

a collar adapted to be disposed within, and connected to, a tubular string;

a surface deployable valve assembly, comprising:

a first tubular member; and a poppet valve connected to the first tubular member, wherein the poppet valve permits fluid flow through the first tubular member in a first direction and prevents fluid flow through the first tubular member in a second direction that is opposite the first direction;

wherein the valve assembly is adapted to be deployable into the tubular string, by injecting the valve assembly into and pumping the valve assembly through the tubular string, and is adapted to be secured to the collar within the tubular string so that the valve assembly is prevented from moving, relative to the collar, in the first and second directions;

a first plug adapted to be deployable into the tubular string, by injecting the first plug into and pumping the first plug through the tubular string, and is adapted to be secured to the valve assembly via a snap ring latch so that the first plug is prevented from moving, relative to the valve assembly, in the first and second directions; and a second plug adapted to be deployable into the tubular string and to be secured to the valve assembly so that the second plug is prevented from moving, relative to the valve assembly, in the first and second directions;

wherein the first plug is adapted to be secured to the second plug, and thus to the valve assembly via the second plug, so that the first plug is prevented from moving, relative to each of the valve assembly and the second plug, in the first and second directions;

wherein the apparatus plugs the tubular string so that fluid flow through the tubular string is not permitted when:

the collar is disposed within, and connected to, the tubular string;

the valve assembly is secured to the collar so that the valve assembly is prevented from moving, relative to the collar, in the first and second directions;

the second plug is secured to the valve assembly so that the second plug is prevented from moving, relative to the valve assembly, in the first and second directions;

the first plug is secured to the second plug, and thus to the valve assembly via the second plug, so that the first plug is prevented from moving, relative to each of the valve assembly and the second plug, in the first and second directions.

2. The apparatus of claim 1, wherein the apparatus plugs the tubular string so that fluid flow through the tubular string is not permitted when:

the collar is disposed within, and connected to, the tubular string;

the valve assembly is secured to the collar so that the valve assembly is prevented from moving, relative to the collar, in the first and second directions; and the first plug is secured to the valve assembly so that the first plug is prevented from moving, relative to the valve assembly, in the first and second directions.

3. The apparatus of claim 1, wherein the valve assembly is secured to the collar in response to relative movement between the collar and the valve assembly in the first direction or the second direction; and wherein the first plug is secured to the valve assembly in response to relative movement between the valve assembly and the first plug in the first direction or the second direction.

4. The apparatus of claim 1, wherein the collar comprises an internal shoulder; and wherein the valve assembly is secured to the collar in response to movement of a portion of the first tubular member in the first direction and past the internal shoulder.

5. The apparatus of claim 1, wherein the first plug comprises:

a generally cylindrical body; and a plurality of axially-spaced wipers extending radially outward from, and circumferentially around, the generally cylindrical body.

6. The apparatus of claim 1, wherein the first plug comprises:

a second tubular member; and a wiper element comprising a tubular body through which the second tubular member extends, and a plurality of axially-spaced wipers extending radially outward from, and circumferentially around, the tubular body;

wherein the valve assembly comprises an internal shoulder; and wherein the first plug is secured to the valve assembly in response to movement of a portion of the second tubular member in the first direction and past the internal shoulder.

7. The apparatus of claim 1, wherein the first plug comprises:

a generally cylindrical body; and a first plurality of axially-spaced wipers extending radially outward from, and circumferentially around, the generally cylindrical body; and wherein the second plug comprises:

an annular locking element;

a rupture disc extending across the annular locking element;

a second tubular member; and a wiper element comprising a tubular body through which the second tubular member extends, and a second plurality of axially-spaced wipers extending radially outward from, and circumferentially around, the tubular body.

8. The apparatus of claim 1 wherein the valve assembly adapted to be deployable into the tubular string, by injecting the valve assembly into and pumping the valve assembly through the tubular string, is adapted to be deployed by application of pressure by fluidic materials to force the valve assembly to flow downwards.

9. The apparatus of claim 1 wherein the surface deployable valve assembly further comprises:

a valve assembly rupture disc, the valve assembly rupture disc disposed within an internal annular groove of the first tubular member.

10. An apparatus, comprising:

a surface deployable valve assembly, comprising:

a first tubular member; and a poppet valve connected to the first tubular member, wherein the poppet valve permits fluid flow through the first tubular member in a first direction and prevents fluid flow through the first tubular member in a second direction that is opposite the first direction;

a surface deployable first plug adapted to be deployable into a tubular string, by injecting the first plug into and pumping the first plug through the tubular string, and to be secured to the valve assembly within the tubular string so that the first plug is prevented from moving, relative to the valve assembly, in the first and second directions; and a surface deployable second plug adapted to be deployable into a tubular string and to be secured to the valve assembly so that the second plug is prevented from moving, relative to the valve assembly, in the first and second directions;

wherein the first plug is secured to the valve assembly in response to relative movement between the valve assembly via a snap ring latch and the first plug in the first direction or the second direction; and wherein the first plug is adapted to be secured to the second plug, and thus to the valve assembly via the second plug, so that the first plug is prevented from moving, relative to each of the valve assembly and the second plug, in the first and second directions.

11. The apparatus of claim 10, wherein the first plug comprises:

a generally cylindrical body; and a plurality of axially-spaced wipers extending radially outward from, and circumferentially around, the generally cylindrical body.

12. The apparatus of claim 10, wherein the first plug comprises:

a second tubular member; and a wiper element comprising a tubular body through which the second tubular member extends, and a plurality of axially-spaced wipers extending radially outward from, and circumferentially around, the tubular body;

wherein the valve assembly comprises an internal shoulder; and wherein the first plug is secured to the valve assembly in response to movement of a portion of the second tubular member in the first direction and past the internal shoulder.

13. The apparatus of claim 10, wherein the first plug comprises:

a generally cylindrical body; and a first plurality of axially-spaced wipers extending radially outward from, and circumferentially around, the generally cylindrical body;

wherein the second plug comprises:

an annular locking element;

a rupture disc extending across the annular locking element;

a second tubular member; and a wiper element comprising a tubular body through which the second tubular member extends, and a second plurality of axially-spaced wipers extending radially outward from, and circumferentially around, the tubular body;

wherein the valve assembly comprises an internal shoulder; and wherein the second plug is secured to the valve assembly in response to movement of a portion of the second tubular member in the first direction and past the internal shoulder.

14. The apparatus of claim 10 wherein the surface deployable first plug adapted to be deployable into the tubular string, by injecting the first plug into and pumping the first plug through the tubular string, is adapted to be deployed by application of pressure by fluidic materials to force the valve assembly to flow downwards.

15. The apparatus of claim 10 wherein the surface deployable valve assembly further comprises:

a valve assembly rupture disc, the valve assembly rupture disc disposed within an internal annular groove of the first tubular member.

16. A method, comprising:

providing a surface deployable valve assembly, the valve assembly comprising:

a first tubular member; and a poppet valve connected to the first tubular member, wherein the poppet valve permits fluid flow through the first tubular member in a first direction and prevents fluid flow through the first tubular member in a second direction that is opposite the first direction; and deploying the valve assembly down a casing string, by injecting the valve assembly into and pumping the valve assembly through the casing string;

securing the valve assembly to a collar installed within the casing string;

deploying a first plug down the casing string, by injecting the first plug into and pumping the first plug through the casing string;

securing the first plug to the valve assembly via a snap ring latch so that the first plug is prevented from moving, relative to the valve assembly, in the first and second directions, wherein the first plug is secured to the valve assembly in response to relative movement between the valve assembly and the first plug in the first direction or the second direction; and securing a second plug to the first plug so that the second plug is prevented from moving, relative to the first plug, in the first and second directions.

17. The method of claim 16, further comprising:

positioning a casing within a wellbore that traverses a subterranean formation;

after positioning the casing within the wellbore, deploying and securing the valve assembly within the casing so that the valve assembly extends entirely within the casing and is prevented from moving relative thereto in the first and second directions;

permitting, using the valve assembly, fluid flow through the casing in the first direction; and preventing, using the valve assembly, fluid flow through the casing in the second direction;

wherein the first plug is secured to the valve assembly after the valve assembly is secured to the casing.

18. The method of claim 17, further comprising connecting a collar to the casing;

wherein deploying the valve assembly down the casing comprises injecting the valve assembly into the casing so that the valve assembly moves in the first direction towards, and relative to, the collar; and wherein the valve assembly is secured to the collar, and thus to the casing, in response to the relative movement between the valve assembly and the collar.

19. The method of claim 17, further comprising:

injecting a hardenable fluidic material into the casing so that the hardenable fluidic material flows in the first direction and through the valve assembly;

forming an annular body of the hardenable fluidic material in an annular region that is radially defined between the wellbore and the casing.

20. The method of claim 17, wherein fluid flow through the casing in the first and second directions is prevented in response to securing the first plug to the valve assembly.

21. The method of claim 16, wherein the first plug comprises:

a second tubular member;

a poppet valve; and a wiper element comprising a tubular body through which the second tubular member extends, and a first plurality of axially-spaced wipers extending radially outward from, and circumferentially around, the tubular body; and wherein the second plug comprises:

an annular locking element;

a rupture disc extending across the annular locking element;

a generally cylindrical body; and a first plurality of axially-spaced wipers extending radially outward from, and circumferentially around, the generally cylindrical body.

22. The method of claim 16 wherein the deploying the valve assembly down a casing string, by injecting the valve assembly into and pumping the valve assembly through the casing string, comprises:

applying pressure by fluidic materials to force the valve assembly to flow downwards.

23. The method of claim 16 wherein the surface deployable valve assembly further comprises a valve assembly rupture disc, the valve assembly rupture disc disposed within an internal annular groove of the first tubular member.

24. A method, comprising:

providing a surface deployable valve assembly, the valve assembly comprising:

a first tubular member; and a poppet valve connected to the first tubular member, wherein the poppet valve permits fluid flow through the first tubular member in a first direction and prevents fluid flow through the first tubular member in a second direction that is opposite the first direction; and deploying the valve assembly down a casing string, by injecting the valve assembly into and pumping the valve assembly through the casing string;

securing the valve assembly to a collar installed within the casing string;

deploying a first plug down the casing string, by injecting the first plug into and pumping the first plug through the casing string; and securing the first plug to the valve assembly via a snap ring latch so that the first plug is prevented from moving, relative to the valve assembly, in the first and second directions, wherein the first plug is secured to the valve assembly in response to relative movement between the valve assembly and the first plug in the first direction or the second direction, wherein securing the first plug to the valve assembly comprises:

securing a second plug to the valve assembly so that the second plug is prevented from moving, relative to the valve assembly, in the first and second directions, wherein the second plug is secured to the valve assembly in response to relative movement between the valve assembly and the second plug in the first direction or the second direction; and securing the first plug to the second plug so that the first plug is secured to the valve assembly via the second plug and thus the first plug is prevented from moving, relative to each of the valve assembly and the second plug, in the first and second directions, wherein the first plug is secured to the second plug in response to the relative movement between the valve assembly and the first plug in the first direction or the second direction.

25. A system, comprising:

a surface deployable valve assembly, wherein the surface deployable valve assembly is adapted to be deployed by application of pressure by fluidic materials to force the valve assembly to flow downwards, comprising:

a first tubular member; and a poppet valve connected to the first tubular member, wherein the poppet valve permits fluid flow through the first tubular member in a first direction and prevents fluid flow through the first tubular member in a second direction that is opposite the first direction;

a snap ring latch means for securing a surface deployable first plug to the valve assembly so that the first plug is prevented from moving, relative to the valve assembly, in the first and second directions, wherein the first plug is secured to the valve assembly in response to relative movement between the valve assembly and the first plug in the first direction or the second direction; and means for securing a second plug to the first plug so that the second plug is prevented from moving, relative to the first plug, in the first and second directions.

26. The system of claim 25, further comprising:

means for, during or after positioning a casing within a wellbore that traverses a subterranean formation, securing the valve assembly to the casing so that the valve assembly extends entirely within the casing and is prevented from moving relative thereto in the first and second directions;

means for permitting fluid flow through the valve assembly, and thus through the casing, in a first direction; and means for preventing fluid flow through the valve assembly, and thus through the casing, in a second direction that is opposite the first direction.

27. The system of claim 25, wherein the first plug comprises:

a second tubular member; and a wiper element comprising a tubular body through which the second tubular member extends, and a first plurality of axially-spaced wipers extending radially outward from, and circumferentially around, the tubular body; and wherein the second plug comprises:

an annular locking element;

a rupture disc extending across the annular locking element;

a generally cylindrical body; and a first plurality of axially-spaced wipers extending radially outward from, and circumferentially around, the generally cylindrical body.

28. The system of claim 25 wherein the valve assembly is adapted to be deployable into a tubular string, by injecting the valve assembly into the tubular string, wherein the application of the pressure by the fluidic materials to force the valve assembly to flow downwards is effected by pumping the valve assembly through the tubular string.

29. The system of claim 25 wherein the surface deployable valve assembly further comprises:

a valve assembly rupture disc, the valve assembly rupture disc disposed within an internal annular groove of the first tubular member.

30. A system, comprising:

a surface deployable valve assembly, wherein the surface deployable valve assembly is adapted to be deployed by application of pressure by fluidic materials to force the valve assembly to flow downwards, comprising:

a first tubular member; and a poppet valve connected to the first tubular member, wherein the poppet valve permits fluid flow through the first tubular member in a first direction and prevents fluid flow through the first tubular member in a second direction that is opposite the first direction; and a snap ring latch means for securing a surface deployable first plug to the valve assembly so that the first plug is prevented from moving, relative to the valve assembly, in the first and second directions, wherein the first plug is secured to the valve assembly in response to relative movement between the valve assembly and the first plug in the first direction or the second direction, wherein means for securing the first plug to the valve assembly comprises:

means for securing a second plug to the valve assembly so that the second plug is prevented from moving, relative to the valve assembly, in the first and second directions, wherein the second plug is secured to the valve assembly in response to relative movement between the valve assembly and the second plug in the first direction or the second direction; and means for securing the first plug to the second plug so that the first plug is secured to the valve assembly via the second plug and thus the first plug is prevented from moving, relative to each of the valve assembly and the second plug, in the first and second directions, wherein the first plug is secured to the second plug in response to the relative movement between the valve assembly and the first plug in the first direction or the second direction.

* * * * *